US006185867B1

(12) United States Patent
McGuire

(10) Patent No.: US 6,185,867 B1
(45) Date of Patent: Feb. 13, 2001

(54) ENTRANCE CONTROL DEVICE FOR SEQUENTIAL DISPLACEMENT OF A PLURALITY OF BARRIERS

(76) Inventor: John Dennis McGuire, 17999 Winston Churchill Boulevard, R.R. #1, Erin, Ontario (CA), N0B 1T0

( * ) Notice: Under 35 U.S.C. 154(b), the term of this patent shall be extended for 0 days.

(21) Appl. No.: 09/276,644

(22) Filed: Mar. 26, 1999

(51) Int. Cl.[7] ..... E05C 7/06
(52) U.S. Cl. ..... 49/109; 49/46
(58) Field of Search ..... 49/68, 35, 49, 49/94, 95, 104, 107, 108, 109, 110, 114, 46

(56) References Cited

U.S. PATENT DOCUMENTS

| | | | | |
|---|---|---|---|---|
| 353,481 | | 11/1886 | Copeland . | |
| 1,872,599 | | 8/1932 | Le Grand . | |
| 2,622,354 | * | 12/1952 | Bacon | 49/109 |
| 3,386,202 | * | 6/1968 | Crews et al. | 49/35 |
| 3,606,698 | * | 9/1971 | Tanaka et al. | 49/35 |
| 3,742,647 | * | 7/1973 | Tomita | 49/68 |
| 4,195,442 | * | 4/1980 | Keeling et al. | 49/35 |
| 4,291,500 | * | 9/1981 | Reckin et al. | 49/68 |
| 4,519,164 | * | 5/1985 | Porter | 49/108 |
| 5,694,867 | * | 12/1997 | Diaz-Lopez | 49/68 |

FOREIGN PATENT DOCUMENTS

WO 93/23799 5/1993 (WO) .

* cited by examiner

*Primary Examiner*—Daniel P. Stodola
*Assistant Examiner*—Curtis A. Cohen
(74) *Attorney, Agent, or Firm*—Eugene J. A. Gierczak

(57) ABSTRACT

An entrance device having at least two barriers to permit entrance in one direction comprising a first barrier manually displaceable from a closed position to an open position and a second barrier manually displaceable from a closed position to an open position when said first barrier is being engaged to achieve said second open position wherein said first and second barriers are presented by said entrance device in sequence.

45 Claims, 20 Drawing Sheets

ENTRANCE CONTROL DEVICE FOR SEQUENTIAL DISPLACEMENT OF A PLURALITY OF BARRIERS

FIELD OF INVENTION

This invention relates generally to an improved gated entrance device permitting passage in one direction. This invention further relates to a gated entrance device having a gate collapsing means for allowing unobstructed traversal of said gated entrance device in either direction in case of an emergency. This invention further relates to a method of traversing a gated entrance device.

BACKGROUND OF INVENTION

This invention relates to the art of self-closing gates or barriers that permit passage in one direction, but not in the other direction.

For example U.S. Pat. No. 5,615,520 granted to John D. McGuire provides for a one-way gate for allowing passage in one direction whose internal mechanical works are concealed within an enclosure, those mechanical works including independent means to perform three function of, first, biasing the gate to return to a closed position; second, limiting the range of motion of the gate between a closed position and a fully open stop; and third, providing a damper to retard the motion of the gate.

Some prior art self-closing gates or barriers permit a person to gain passage through said one-way gate in a direction opposite to said one direction by displacing said gate or barrier said one direction and passing through the resulting unobstructed passageway. There is a need therefore for entrance devices which prevent the one-way gate or barrier from being "tampered" in this way. For example, WO 93/23799 provides for at least one entrance gate, and a system for controlling entrance through said entrance gates comprising, first, entrance passageway defined by posts on which gates are pivotally mounted; second, a sonar sensor means which functions to detect the presence of people and objects in the vicinity of the passageway and to deliver signals to a control means for controlling opening and closing of the gate; wherein said sonar sensor means includes at least one sonar which is mounted in or in the vicinity of the passageway.

The prior art entrance device utilizing sonar is complicated in that said entrance device requires, first, a sonar emitting device; second, an electronic unit for amplifying sonar pulses; third, a microprocessor for sampling said sonar signals; fourth, a microprogram operably associated with said microprocessor for processing said sonar signals to a further microprocessor which controls opening and closing of the gates. Operation of said prior art entrance device utilizing sonar also requires configuration of said microprocessors to store input related to a defined external measuring area within which objects are detected by said sonar sensing means.

There is a need therefore for an entrance device of simple construction that is easy and inexpensive to produce, that can be installed without difficulty, and which is easy to operate.

SUMMARY OF THE INVENTION

In accordance with a first aspect of the invention, an entrance device is provided having at least two barrier means to permit entrance in one direction comprising, a first barrier means manually displaceable from a closed position to an open position; and second barrier means manually displaceable from a closed position to an open position when said first barrier means is being engaged to achieve said second open position; wherein said first and second barrier means are presented by said entrance device in sequence.

In another aspect of this invention, an entrance device to permit entrance in one direction is provided, said entrance device comprising: (a) at least one partition member defining a passageway; (b) first barrier arm assembly mounted on said partition member, said first barrier arm assembly comprising, (i) a first barrier arm, and (ii) first barrier arm rotor means connected to said first barrier arm and rotatably mounted on said partition member and adapted for manual rotation of said first barrier arm between a first closed position and second open position; a (c) second barrier am assembly mounted on said partition member and spaced apart from said first barrier arm assembly, said second barrier assembly comprising, (i) a second barrier arm; (ii) second barrier arm rotor means connected to said second barrier arm and rotatably mounted on said partition member and adapted for manual rotation of said second barrier arm between a first closed position and second open position; and (iii) sequential barrier arm rotor releasing means comprising, (A) a stopping means comprising, a stopping member presented by said partition member adjacent to said second barrier arm rotor means; and stopping arm presented by said second barrier arm rotor means and operably associated with said stopping member, wherein said stopping means prevents rotation of said second barrier arm rotor means from said closed position toward said open position; and (B) releasing means for displacing said stopping member, thereby releasing said stopping means when said first barrier arm rotor means is rotated from said closed position toward said open position, and thereby allowing rotation of said second barrier arm rotor means from said closed position toward said open position.

In a further aspect of tie invention, one may additionally find a collapsing means for manually displacing said first and second barrier arms from said first closed position or second open position to achieve a third collapsed position wherein said first and second barrier arms permit unobstructed passage through said passageway.

In a still Her aspect of the invention, a method of traversing an entrance device having at least a first and second manually operable barrier means mounted in sequence on at least one partition member comprising the steps of: (a) manually displacing said first barrier arm so as to allow passage past said first barrier arm; (b) said first barrier arm releasing a blocking means that prevents displace of said second barrier arm, so as to allow passage past said second barrier arm by having displaced said first barrier arm; and (c) manually displacing said second barrier arm so as to exit said entrance device.

BRIEF DESCRIPTION OF DRAWINGS

A detailed description of the preferred embodiments are provided herein below, by way of example only, with reference to the following drawings, in which:

FIG. 1 is a perspective view of a preferred embodiment of the access control device with the casing on.

Figure 1:
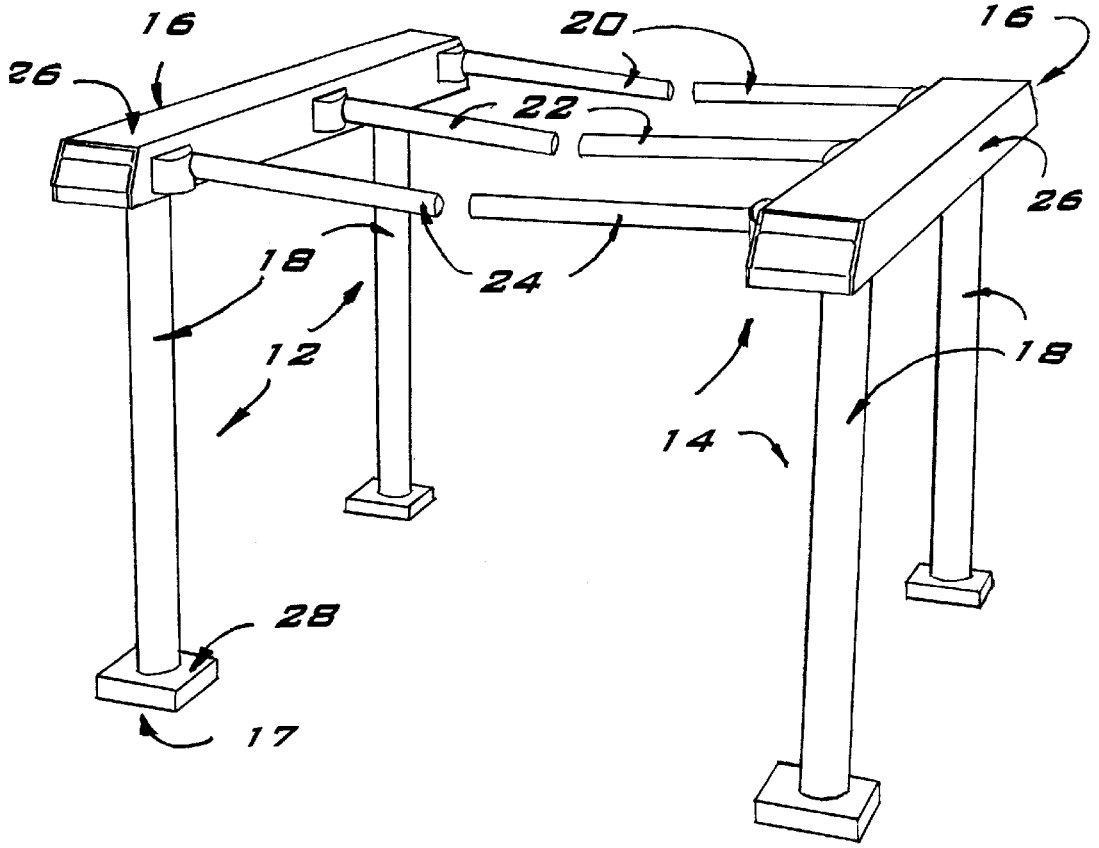

In the drawings, preferred embodiments of the invention are illustrated by way of example. It is expressly understood that the description and the drawings are only for the purpose of illustration and as an aid to understanding and are not intended as a definition of the limits of the invention.

BEST MODE FOR CARRYING OUT THE INVENTION

In the description which follows, like parts are marked through the specification and the drawings with the same respective reference numerals. The drawings are not necessarily to scale, and in some instances proportions may have been exaggerated in order to more clearly depict certain features of the invention.

Referring to FIG. 1, there is illustrated a first preferred embodiment of the entrance device 10 in which there are three pairs of barrier arms. In this first preferred embodiment of the invention, the entrance device comprises a first partition member 12 and second partition member 14. Each of said first and second partition members 12, 14 further comprises a top member 16 and pair of support posts 18 for supporting each of said top members 16. Each of said first and second partition members 12, 14 further comprise a first barrier arm 20, second barrier arm 22 and third barrier arm 24 which are mounted on said top members 16, in a manner 16, in a manner made evident below.

Each of said top members 16 includes a casing 26 for enclosing the mechanism as shown in the drawings corresponding to each of said first, second and third barrier arms 20, 22, 24 and described in detail below.

Each of said supporting posts 18 further comprises a base 28 for fixing each of said partition members 12, 14 to the floor or ground by means of an attachment means, for example, a flange 17 associated with said supporting posts 18, which flange presents holes for receiving screws which are secured into the ground floor. Partition members 12, 14, are fixed to the floor or ground spaced apart from each other so as to delimit or define a passageway, as shown in FIG. 1.

It should be understood that while a pair of supporting posts 18 are illustrated herein as means for supporting top member 16, this invention also contemplates alternate means for supporting top member 16, such as one support post for supporting each of said top members 16, attaching said top member 16 to a support wall extending all or substantially all the length of top member 16, or attaching said top member 16 to an existing barrier such as a wall, using an attachment means such as screws or the like.

Figure 2:
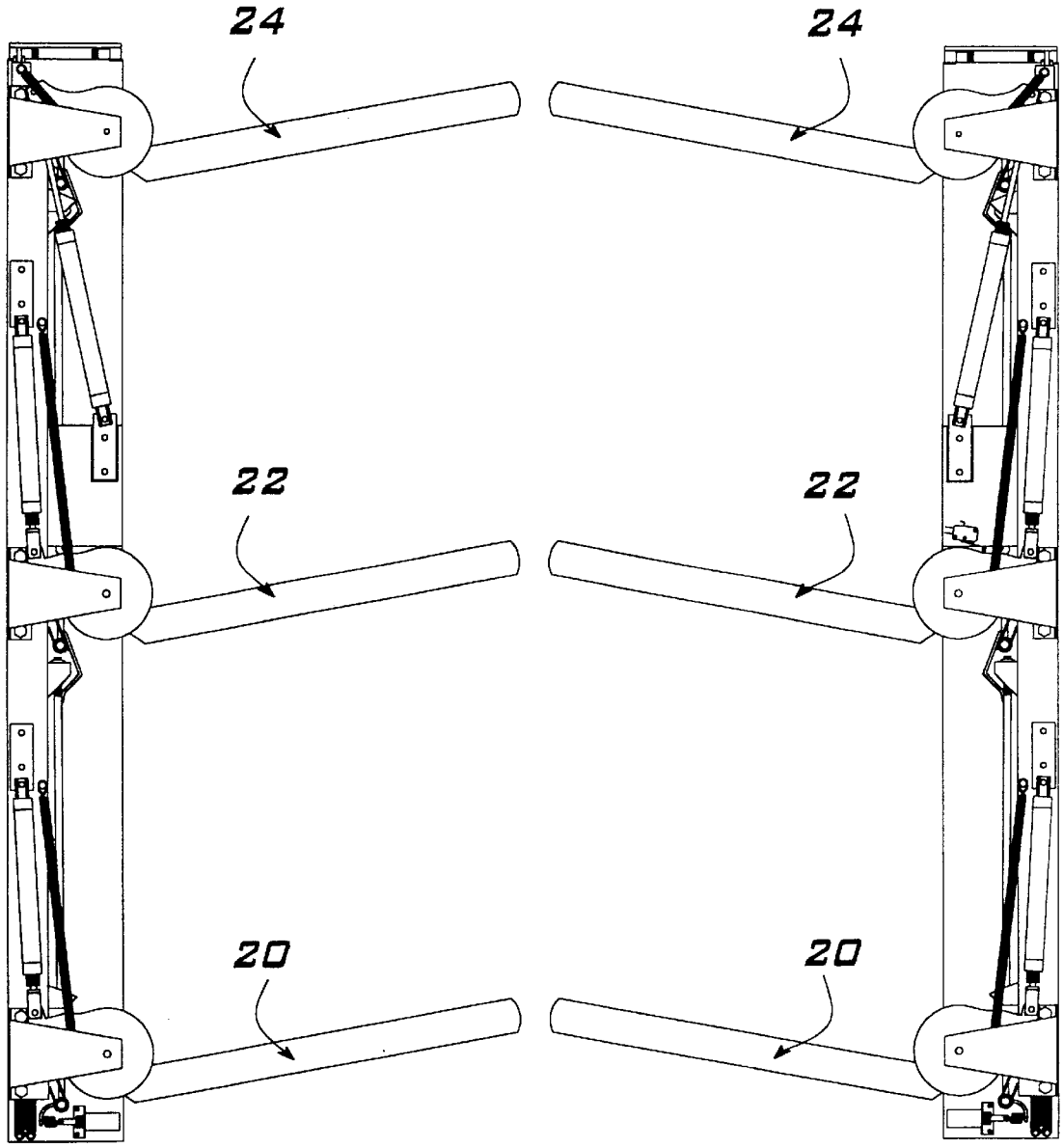
FIG. 2 is a top plan view of the access control device shown in FIG. 1 with the casing removed.

Each of said first and second partition members 12, 14 present the same mechanical structure when casing 26 is removed, as best illustrated by FIG. 2, which presents a top view of top member 16 of each of said first and second partition members 12, 14 with casing 26 removed.

Figure 3:
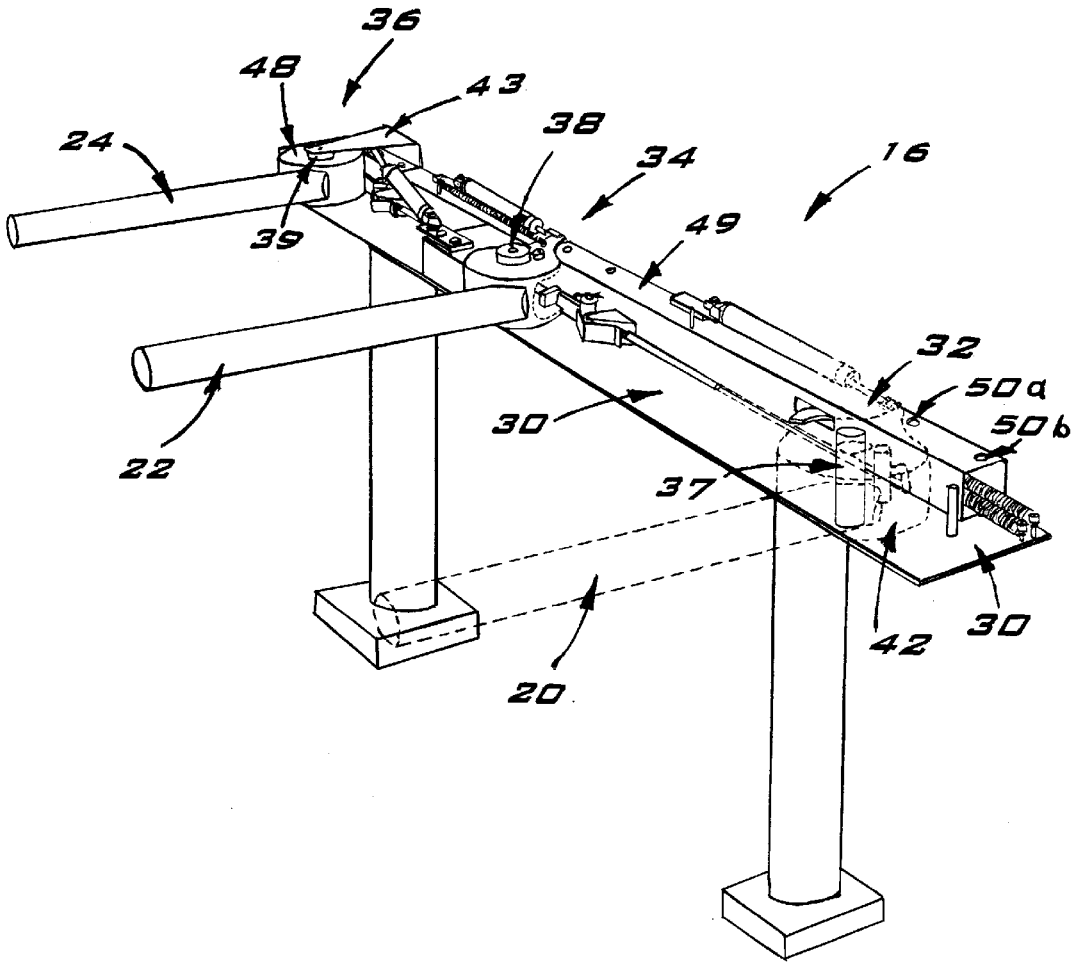
FIG. 3 is a perspective view of one side of FIG. 1 with the casing off.

Now referring to FIG. 3, the various structural elements of each of said first and second partition members 12, 14 are illustrated. More specifically FIG. 3 shows the complete third barrier arm assembly 34 has the rotor post reinforcing bracket 43 removed, and the first rotor arm assembly 32 drawn with phantom lines to better illustrate the first rotor post 37. Top member 16 presents main plate 30, first barrier arm assembly 32, second barrier assembly 34 and third barrier arm assembly 36. Main base plate 30 presents first, second and third rotor posts 37, 38 and 39.

Figure 4:
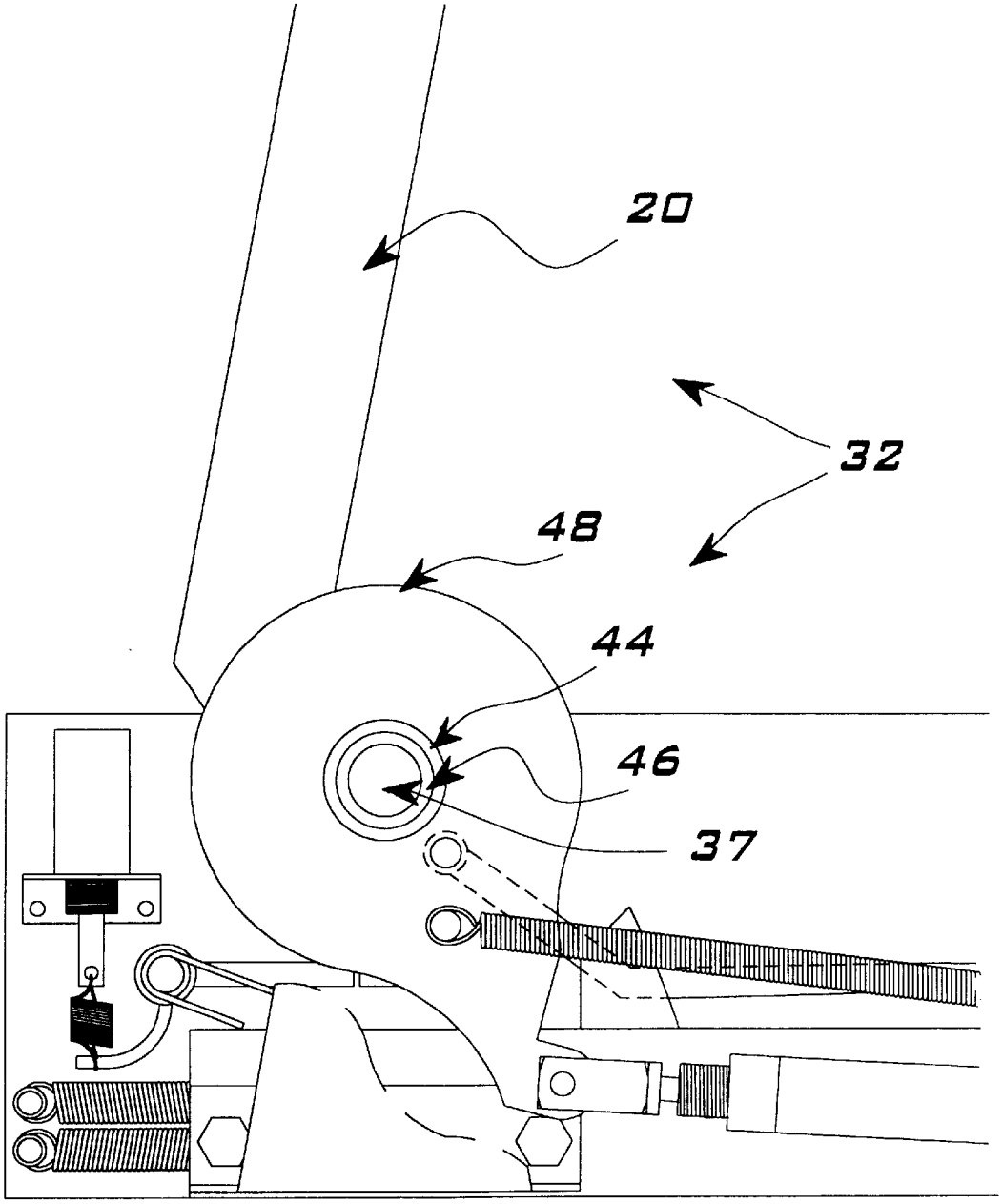
FIG. 4 is a top plan view of the first barrier assembly.
Figure 7:
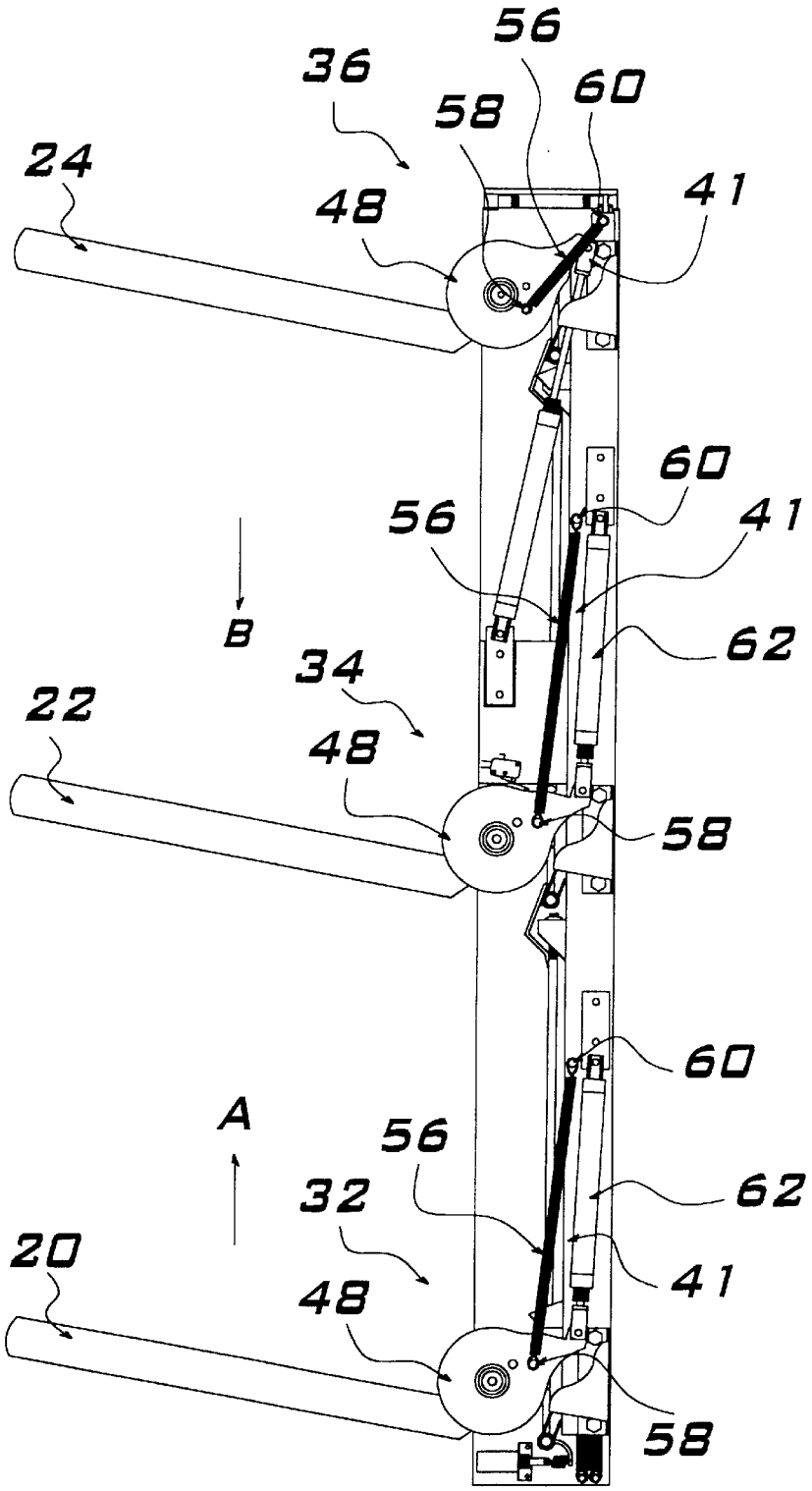
FIG. 7 is a top plan view of the first, second and third barrier arm assemblies.

Now referring to FIG. 4, the structure of said first barrier arm assembly 32 is represented, which structure is also representative of said second and third barrier arm assemblies 34, 36, and also of the arm assemblies which are part of the various embodiments of the invention described below. FIGS. 4 and 7 show rotor post reinforcing bracket 43 in partial cut away view.

Said first barrier arm assembly 32 comprises said first barrier arm 20 which is connected to a rotor bottom plate 42 (see FIG. 9*a*) spaced from a rotor top plate 48 (see FIG. 7). A rotor bearing tube 44 is disposed between the rotor bottom plate 42 and rotor top plate 48 and receives and rotationally engages rotor bearing 46. Said rotor bottom plate 42 and rotor bearing 46 are received by said rotor post 37 thereby permitting manual rotation of barrier arm 20 about said rotor post 37. The first, second and third barrier arm assemblies 32, 34 and 36 also present side covers 31, 33 and 35.

As best shown in FIG. 3, each of said first, second and third barrier arm assemblies 32, 34, 36 further includes a rotor post reinforcing bracket 43 which is placed on top of barrier arm assemblies 32, 34, 36 so as to prevent them from being removed from said rotor posts 37, 38, 39 while permitting rotatable displacement of said rotor bottom plate 42 (as shown in FIG. 3). Said main base plate 30 further presents main support tube 49. Main support tube 49 presents fastening holes 50*a,* 50*b* which communicate with corresponding holes presented by said rotor post reinforcing bracket 43, whereby said rotor post reinforcing bracket 43 is secured to said main support tube 49 using fastening means such as nuts and bolts, or the like. The rotor post reinforcing bracket 43 reinforces the rotor post in that it restricts deflection of the barrier arm assembies 32, 34 and 36 when for example some one hangs from the barrier arms 20, 22 and 24.

Figure 5:
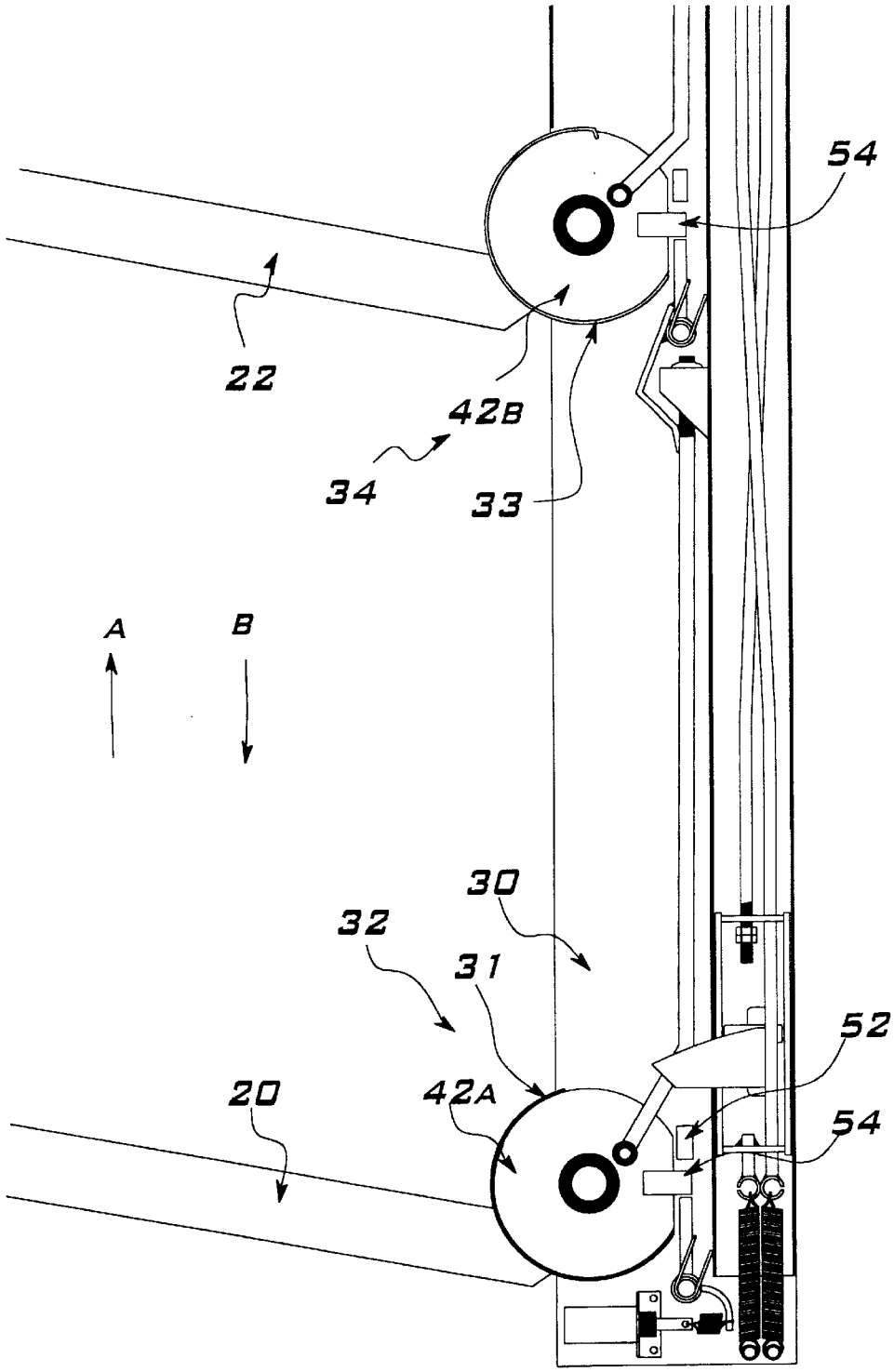
FIG. 5 is a top plan view of the first and second barrier assembly in a closed position.
Figure 6:
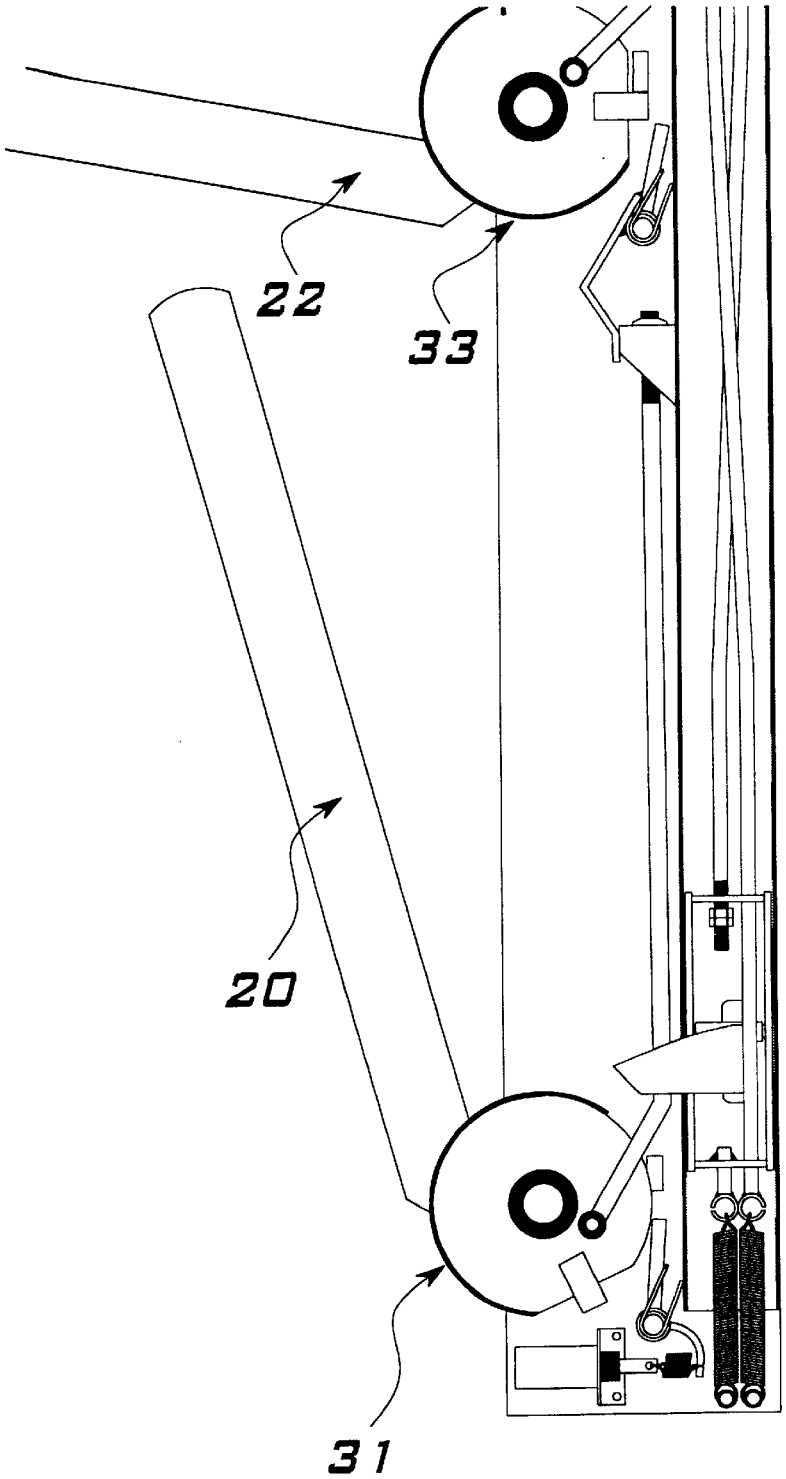
FIG. 6 is a top plan view of the first and second barrier assembly with the first barrier arm in an open position.

In accordance with the above, said first barrier arm assembly 32 permits manual displacement of said first barrier arm 20 from a first closed position to a second open position. Referring to first barrier assembly 32, as illustrated in FIG. 5, barrier arm 20 is shown in said first closed position. Now referring to first barrier arm assembly 32, as illustrated in FIG. 6, barrier arm 20 is shown in said second open position.

Now referring to FIG. 5, one provides means for resisting or inhibiting movement of said barrier arm 20 in a direction other than said one direction (said one direction being direction "A") when said barrier arm 20 is in said closed position. In the embodiments of the present invention described herein, said means for inhibiting movement is presented by a base plate stop 52 which is presented by said main base plate 30, and further by rotor stop block 54 which is presented by rotor bottom plate 42. As best shown in FIG. 5, said base plate stop 52 comes into contact with rotor stop block 54 when an attempt is made to rotate said barrier arm 20 in a direction opposite to said direction A (direction B) when said barrier arm 20 is in said first closed position.

As illustrated in FIG. 7, the various embodiments of the invention described herein also provide for a biasing means 41 for said barrier arms 20, 22, 24 to be biased toward said first closed position. Said biasing means 41 prevents passage through said entrance device 10 in said direction B by ensuring that once a person has passed through said entrance device in direction A, said barrier arms 20, 22, 24 return to said closed position to obstruct passage through said entrance device 10. In the embodiments of the invention described herein, said biasing means 41 is presented by a rotor return spring 56 which is preferably operably associated with each of said barrier arm assemblies 32, 34, 36. Said rotor return spring 56 is mounted between a spring pin 58 presented by said rotor top plate 48, and spring post 60 presented by said main support tube 49.

In order to prevent said barrier arm assemblies 32, 34, 36 to return from said second open position to said first open position with great force in combination with said rotor return spring 56, and thereby possibly causing injury to person traversing said entrance device 10 soon after another person, it is desirable to associate some form of dampening means with said barrier arm assemblies 32, 34, 36. As best shown in FIG. 7, in the embodiments of the invention described herein, said dampening means is presented by a dampening cylinder 62 which is also operably associated preferably with each of said barrier arm assemblies 32, 34, 36. Said dampening cylinder 62 is mounted to said main support tube 49 and operably connected with said rotor top plate 48, again as illustrated in FIG. 7.

Figure 8:
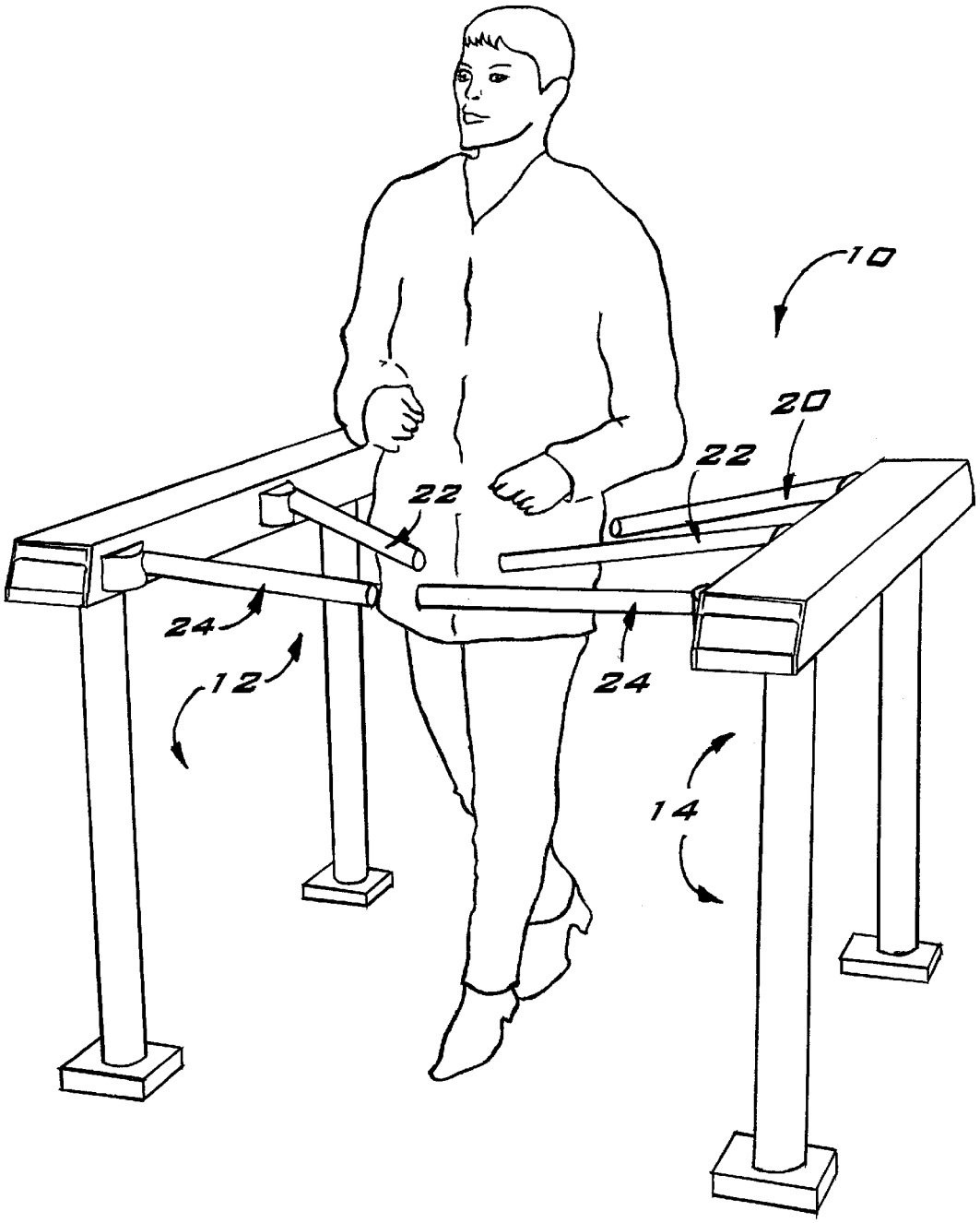
FIG. 8 is a perspective view showing the use of the access control device.

FIG. 8 illustrates said entrance device 10 in operation by reference to the first embodiment of the invention disclosed herein, and shows the passage of a person between said first and second partition members 12, 14. The entrance device 10 described herein restricts passage therethrough into passage in said one direction only by means of a sequential releasing means. Said sequential releasing means presents means for permitting displacement of second barrier arm 22 only once said first barrier arm 20 has been previously displaced; and of the third barrier arm 24, in turn, only once said second barrier arm 22 has been previously displaced.

As particularized below, said sequential releasing means can either be provided mechanically or electronically.

Again in reference to FIG. 7, said sequential releasing means is illustrated which more particularly operates as follows. When said first barrier arm 20 is displaced, said second barrier arm 22 is thereby mechanically released by way of said sequential releasing means, so long as said first barrier arm 20 has not yet returned to said first closed position. Similarly, manual displacement of said second barrier arm 22 in turn releases said third barrier arm 24 thereby permitting said third barrier arm 24 to be opened, but only so long as said second barrier arm 22 has not yet returned to said first closed position.

The biasing means 41 and dampening cylinder 62 may be adjusted in a manner well-known to those skilled in the art, in order to provide for return of said first and second barrier arms 20, 22 to said first closed position more slowly than it would take such person to make its way from one barrier arm to the next barrier arm so as to minimize the chance of the first and second barrier arm 20, 22 returning to the first closed position too quickly and before the next barrier arm can be manually displaced. Moreover, the length of the arms 20, 22 and 24 tend to contact a user and then swing to the closed position once the user has passed through the appropriate position.

Figure 9A:
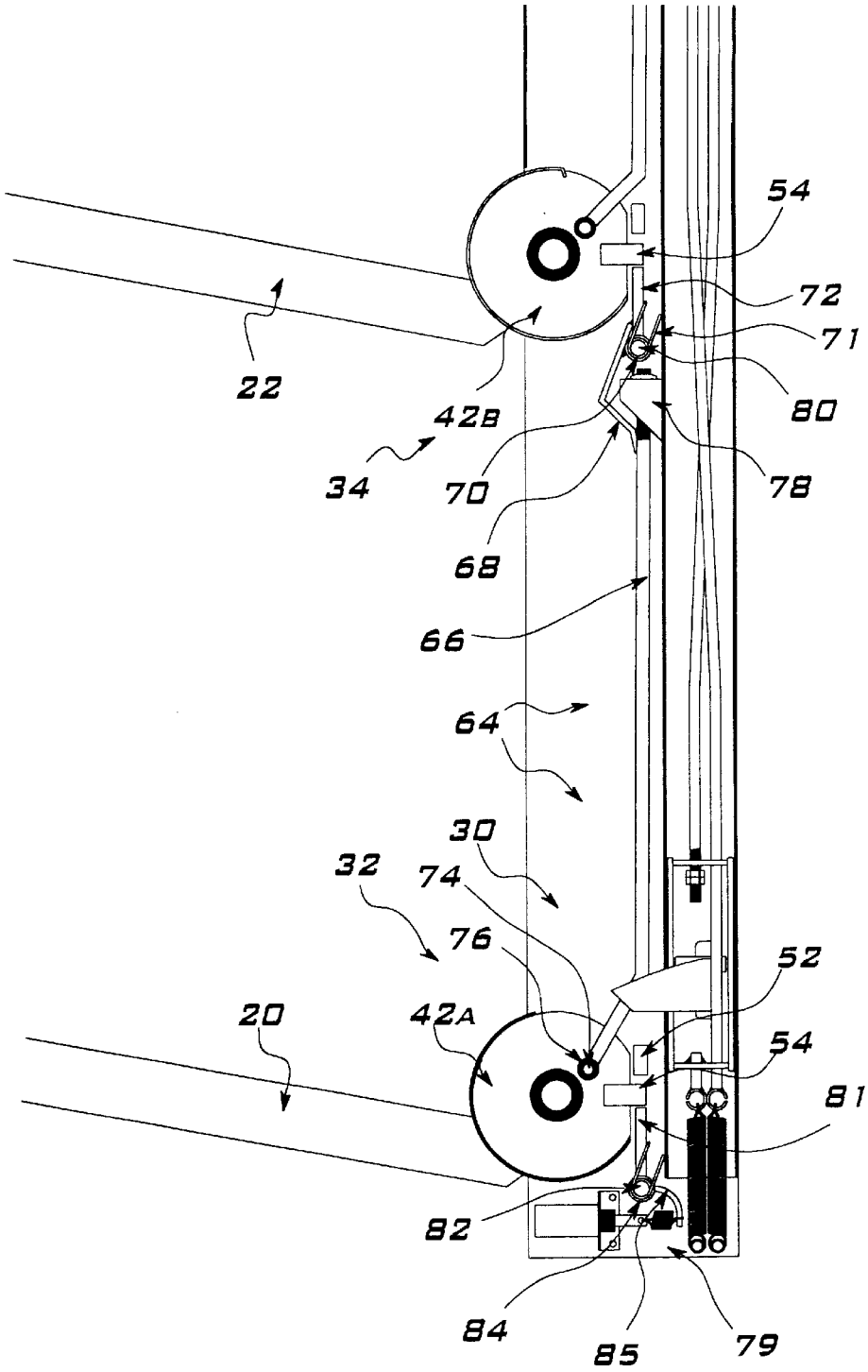
FIGS. 9*a,* 9*b,* 9*c* and 9*d* are views showing different stages of the second and third barrier assemblies.

Now referring to FIG. 9*a,* a preferred embodiment of a fist mechanical sequential releasing means 64 is illustrated, which in this figure is operably associated with said first and second barrier arm assemblies 32, 34. Said first sequential releasing means 64 comprises a rotor release rod 66, pivot cam arm 68, pivot bushing 70, and pivot stop bar 72.

Said rotor release rod 66 is pivotably or rotatably connected to said first rotor bottom plate 42*a* by means of rotor release stud 74 presented by the top of said first rotor bottom plate 42*a* and rotor busing 76. Connected to said rotor release rod 66 at the end of said rotor release rod 66 opposite to said rotor release stud bushing 76 is a rotor release block 78.

Said main base plate 30 further presents a pivot assembly post 80. Said pivot cam arm 68 and pivot stop bar 72 are rotatably mounted on said pivot assembly post 80 by means of said pivot bushing 70, whereby said pivot stop bar 72 can be rotated from a first blocking position in which said pivot stop bar 72 blocks said rotor stop block 54, thereby preventing rotation of said second barrier arm 22 from said first closed position to said second open position; to a second releasing position wherein said rotor stop block 54 is released hereby permitting manual displacement of said second rotor bottom plate 42*b*.

Figure 9B:
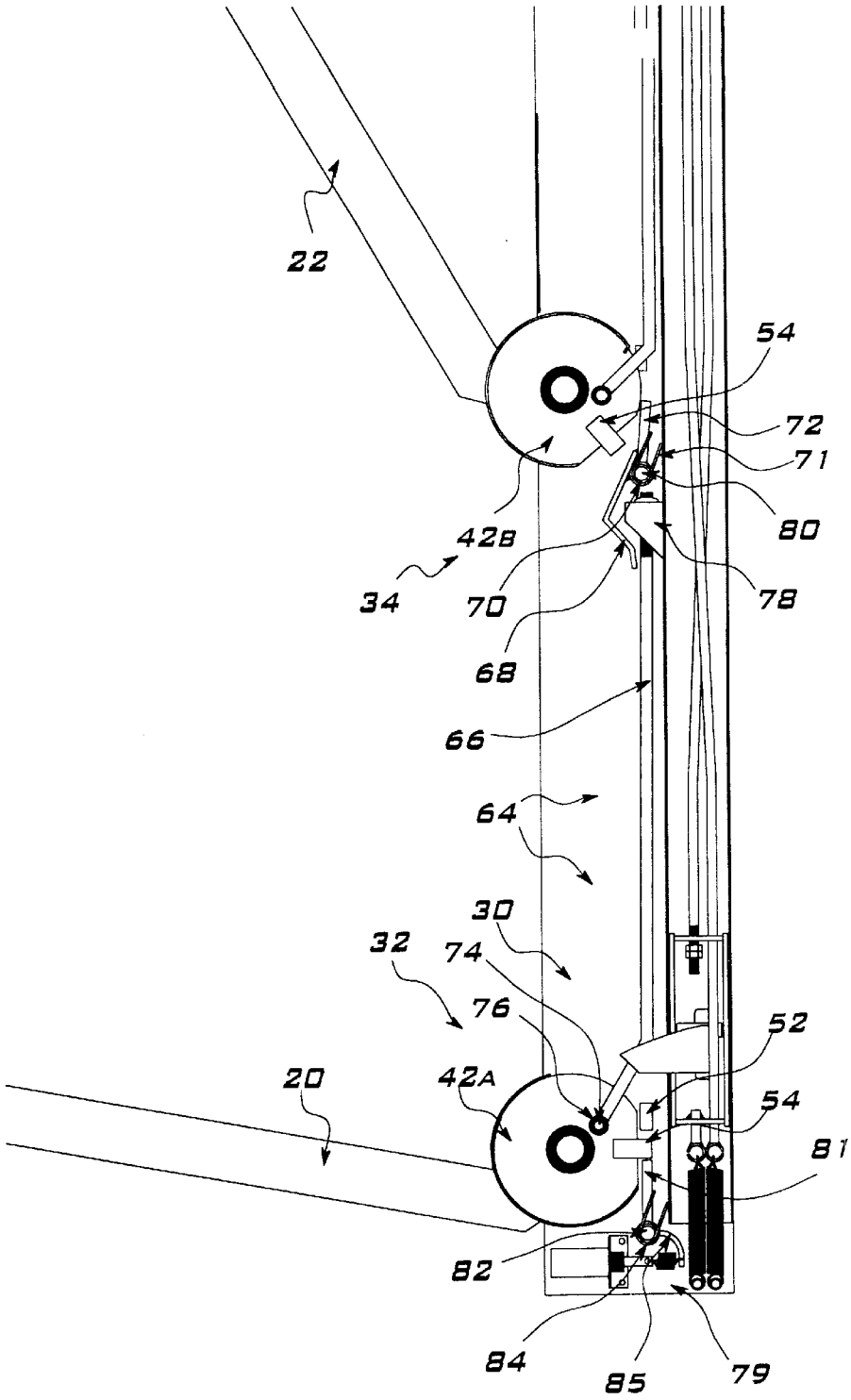
Figure 9C:
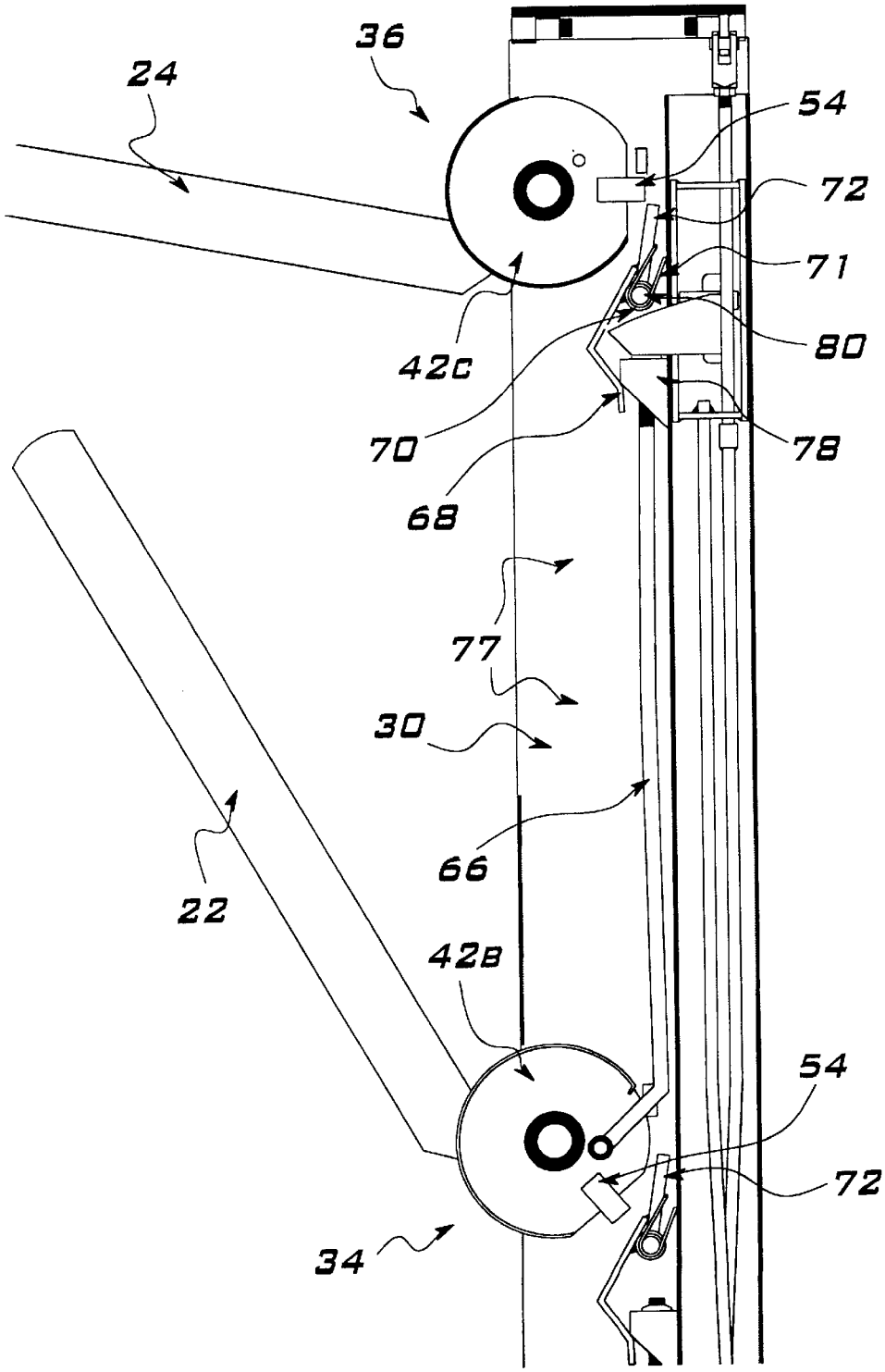
Figure 9D:
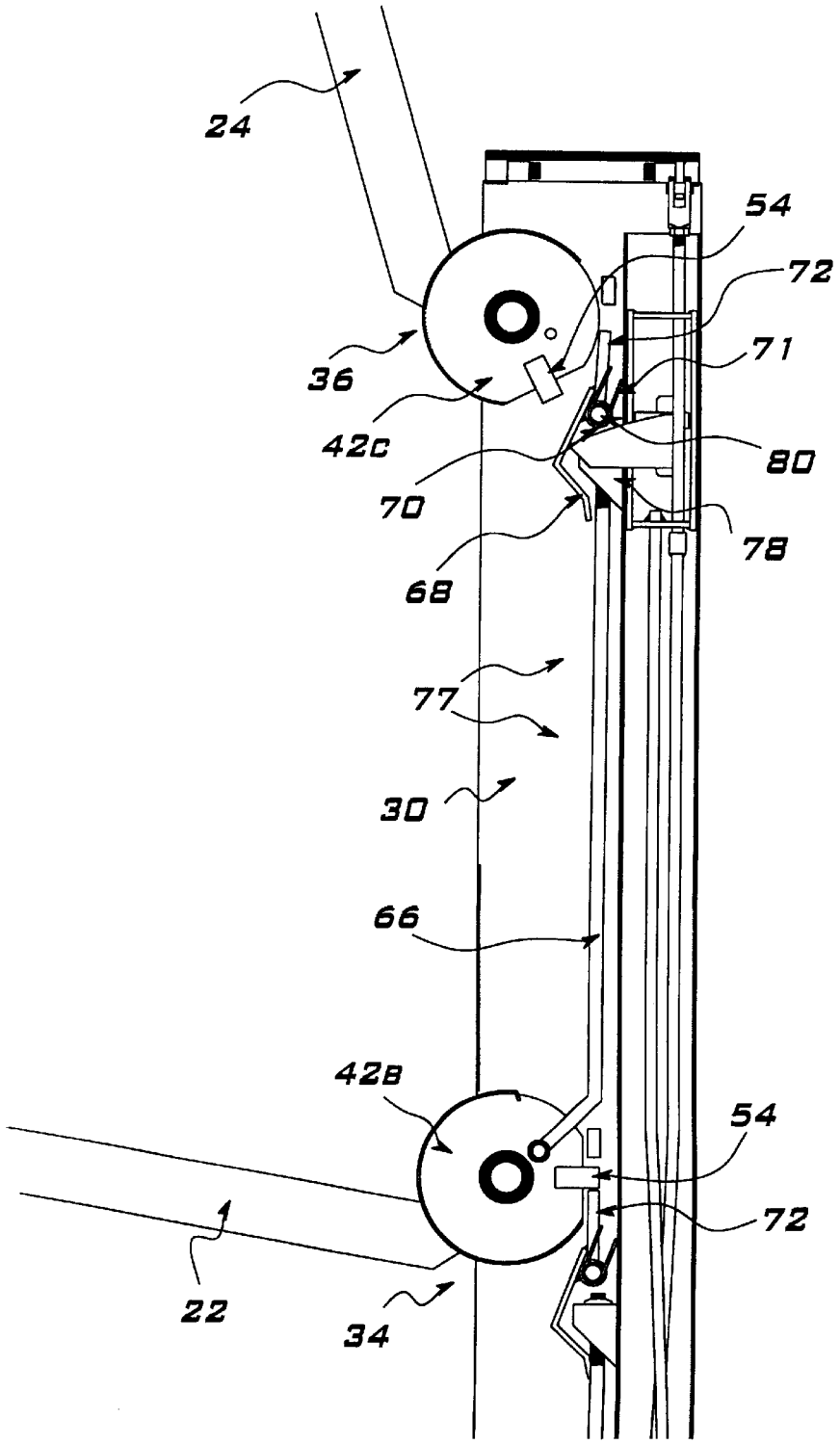

In operation, as best shown in FIG. 9*b,* when said first barrier arm 20 is manually displaced, said rotor bottom plate 42*a* is rotated, and thereby said rotor release rod 66 is displaced atop said main base plate 30 toward said first barrier arm assembly 32. Said displace of said rotor release rod 66 causes said rotor release block 78 to displace said pivot cam arm 68 thereby causing pivot stop bar 72 to rotate away from said second rotor bottom plate 42*b*. Rotor stop block 54 is consequently released, thereby permitting said second barrier arm 22 to be manually displaced from said first closed position to said second open position.

A pivot assembly return spring 71 biases said pivot stop bar 72 toward said first blocking position. Consequently, when said first rotor bottom plate 42*a* returns to said first closed position by means of said rotor return spring 56 and dampening means 62, said pivot stop bar 72 again blocks said rotor stop block 54, thereby preventing rotation of said second rotor bottom plate 42*b* from said first closed position to said second open position.

Said third barrier arm assembly presents a second releasing means 77 identical to said first sequential releasing means 64 for releasing said third barrier arm 24 when said second barrier arm 22 is manually displaced, as best shown in FIG. 9*e,* 9*d*.

Also as best shown in FIG. 9*a,* said first barrier arm assembly 32 may also be provided with a first rotor blocking means 79 for prevent said first rotor bottom plate 42*a* from being rotated from said first closed position to said first open position. Said first rotor blocking means 79 is presented by a first barrier stop bar 81 which is mounted on said main base plate 30 by means of a first barrier post 82, along with first barrier bushing 84 to provide for rotatable displacement of said first barrier stop bar 81 from a first blocking position in which said first barrier stop bar 81 blocks said rotor stop block 54, thereby preventing rotation of said first barrier arm 20 from said first closed position to said second open position; to a second releasing position wherein said rotor stop block 54 is released thereby permitting manual displacement of said first rotor bottom plate 42*a*.

Further associated with said first barrier stop bar 81 is a rotating arm 85. Said rotatable displacement of said first barrier stop bar 81 can be obtained by providing various means for engaging said rotating arm 85, such as a turn-key release, or solenoid combined with an access card reader or remote activation, connection to fire alarm systems, proximity sensors or similar devices.

Figure 10:
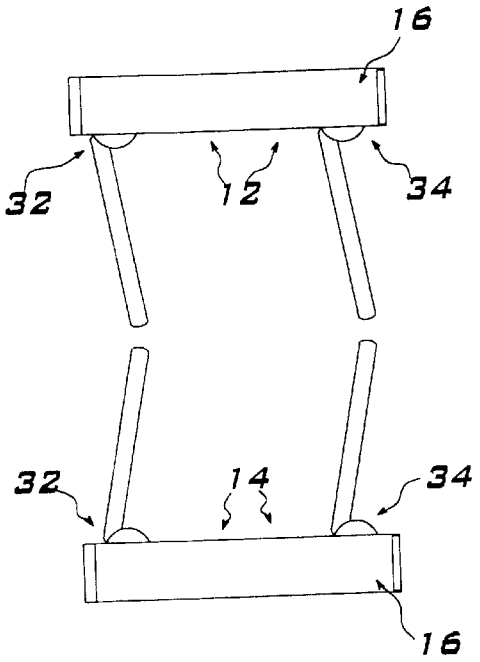
FIG. 10 is a top plan view of another embodiment of the invention.

In a second preferred embodiment of the entrance device described herein, each of said first and second partition members comprises two barrier arm assemblies 32, 34 comprising the constituent elements described above, as shown in FIG. 10.

Figure 11:
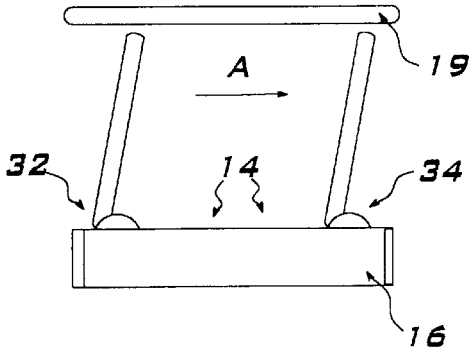
FIG. 11 is a top plan view of yet another embodiment of the invention.

In a third preferred embodiment of the entrance device described herein, said entrance device comprises only one partition member having two barrier arm assemblies 32, 34 wherein a passageway is defined by said partition member, and an external barrier such as a wall or barrier, or handrail mounted on a wall, as shown in FIG. 11.

Figure 12:
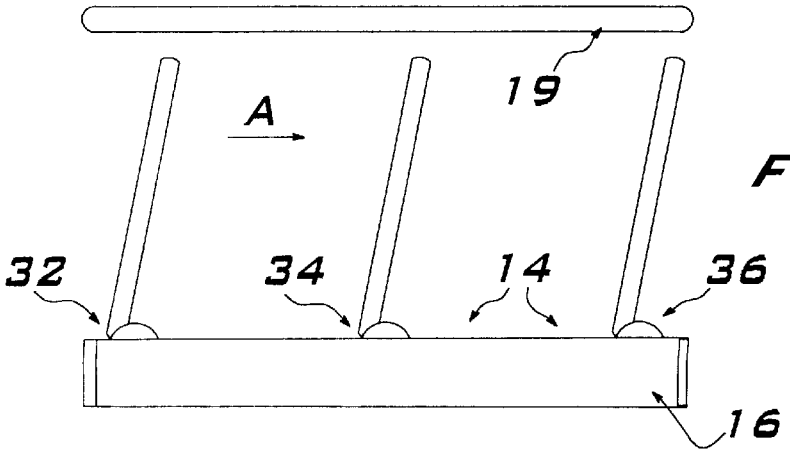
FIG. 12 is a top plan view of a further embodiment of the invention.

In a fourth preferred embodiment of the device described herein, said entrance device also cobs only one partition member, but said partition member present three barrier arm assemblies, as illustrated in FIG. 12.

In a fifth preferred embodiment of the entrance device described herein, said entrance device is provided with barrier arm configurations of either of said first, second, third or fourth embodiments of the invention described herein, and an electronic sequential releasing means rather than the mechanical sequential releasing means described above. Said electronic sequential releasing means consists of a solenoid operably associated with said second barrier stop bar 72, and sensing means for sensing when said first barrier am is displaced from said first closed position to achieve said second open position, wherein said senor is activated when said first barrier arm 20 is displaced from said first closed position to achieve said second position so as to engage said pivot stop bar 72 thereby permitting manually displacement of said second rotor bottom plate 42*b*, as described above. Said sensing means may be provided, for example, by a photo electric beam. Any subsequent barrier arm assemblies, if any, are similarly provided with a sensing means and solenoid.

In a modification to the fifth preferred embodiment sensing means such as a photo electric beam or the like could be placed in advance of any barrier arm 20, 22, 24 to indicate the presence of a person attempting to traverse the entrance device in the desired direction "A", whereupon the signal from the beam would activate the solenoid operably associated with the barrier arm to which the person is attempting to traverse.

Figure 13:
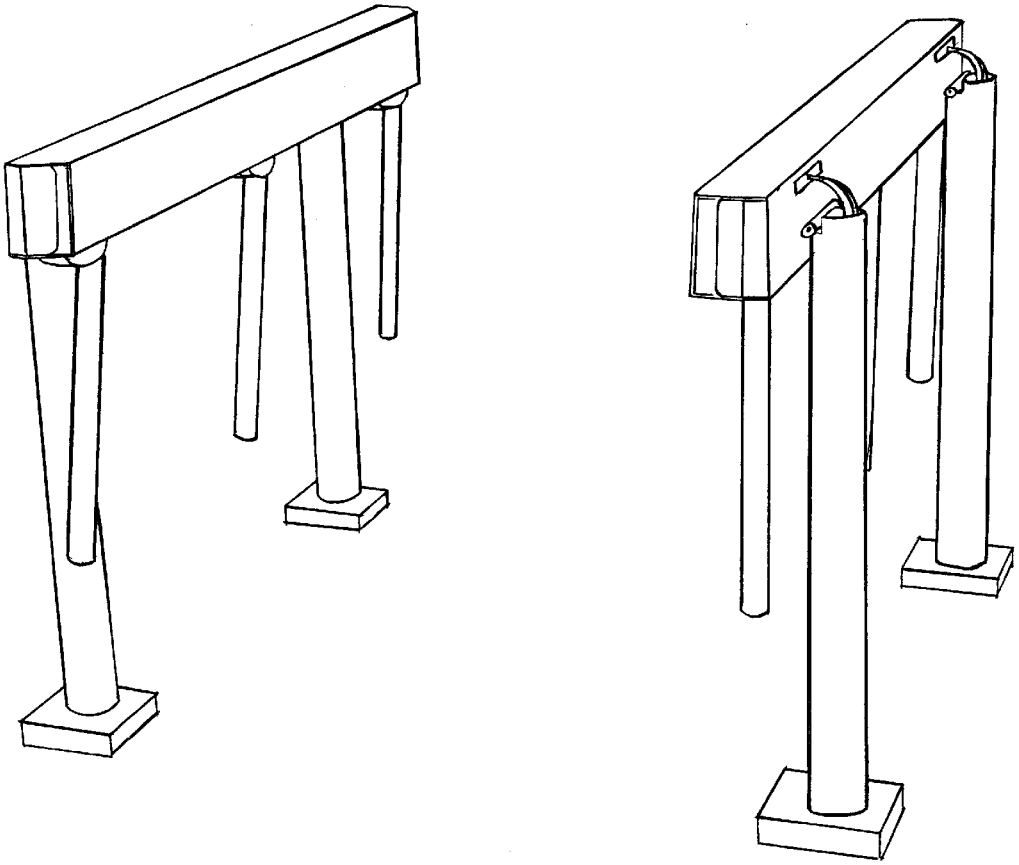
FIG. 13 is a perspective view showing the access control device in a collapsed position.

In a sixth preferred embodiment of the invention described herein, said entrance device is further provided with a collapsing means for displacing said barrier arms 20, 22, 24 presented by either of said first, second, third or fourth preferred embodiments of the invention described above, from said first closed position or second open position to achieve a third collapsed position wherein said barrier arms permit unobstructed passage through said passageway. FIG. 13 illustrates the collapsed position. The entrance device could be collapsed in the event of an emergency so as to prevent unobstructed passage through the device in both directions in the event of a fire or the like.

Figure 14:
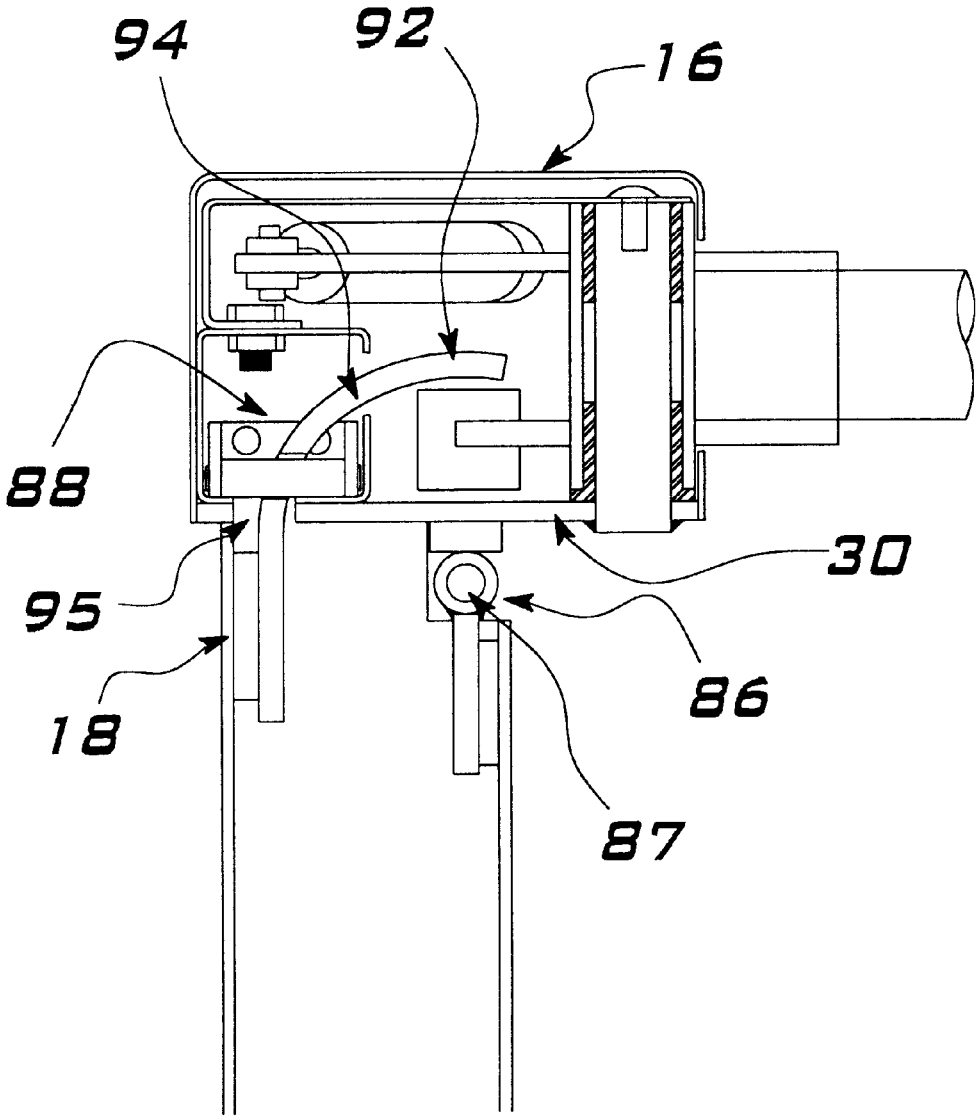
FIG. 14 is a partial vertical cross-section of the access control device.

As best shown in FIG. 14, the preferred embodiment of said collapsing means is provided by a hinge means 86, displaceable locking means 88, wherein said hinge means 86 is presented by a pivot shaft 87 around which said top member 16 may be pivoted.

In the preferred embodiment of said collapsing means described herein, said hinge means 86 is presented by each of said support posts 18, however said hinge means 86 could be easily adapted to be presented by a single support post or alternate means for supporting top member 16 such as a support wall by fixing said hinge means 86 to the top of such a support wall using a flange and screws, for example.

Figure 15:
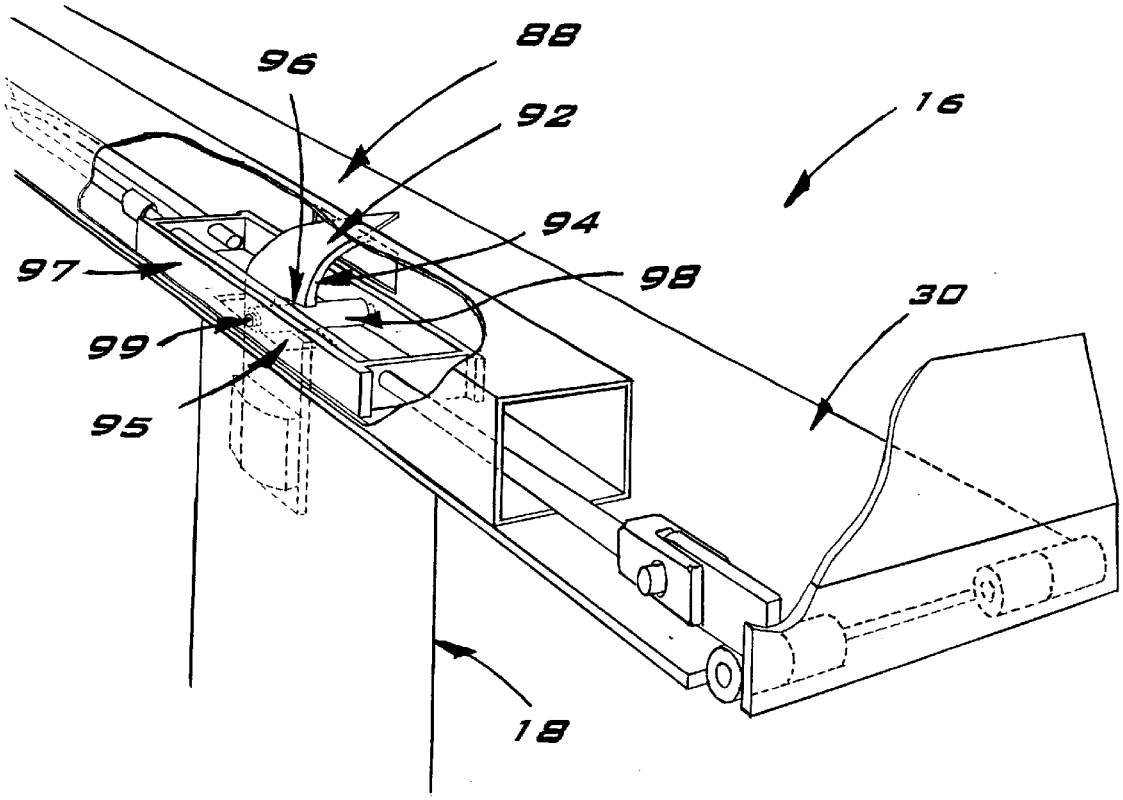
FIG. 15 is a partial perspective view of the access control device illustrating structure for collapsing the access control device.

As illustrated in FIG. 15, said top member 16 and support posts 18 present said displaceable locking means 88 by providing a collapsing ramp 92 secured to post 18. The collapsing ramp 92 communicates with bottom opening 95 of said main base plate 30. Said collapsing ramp 92 comprises a ramp edge 94 and locking notch 96. Said top member 16 provides a break away roller 98 which is biased to engage said locking notch 96 and thereby hold said hinge means 86 in place.

Figure 16A:
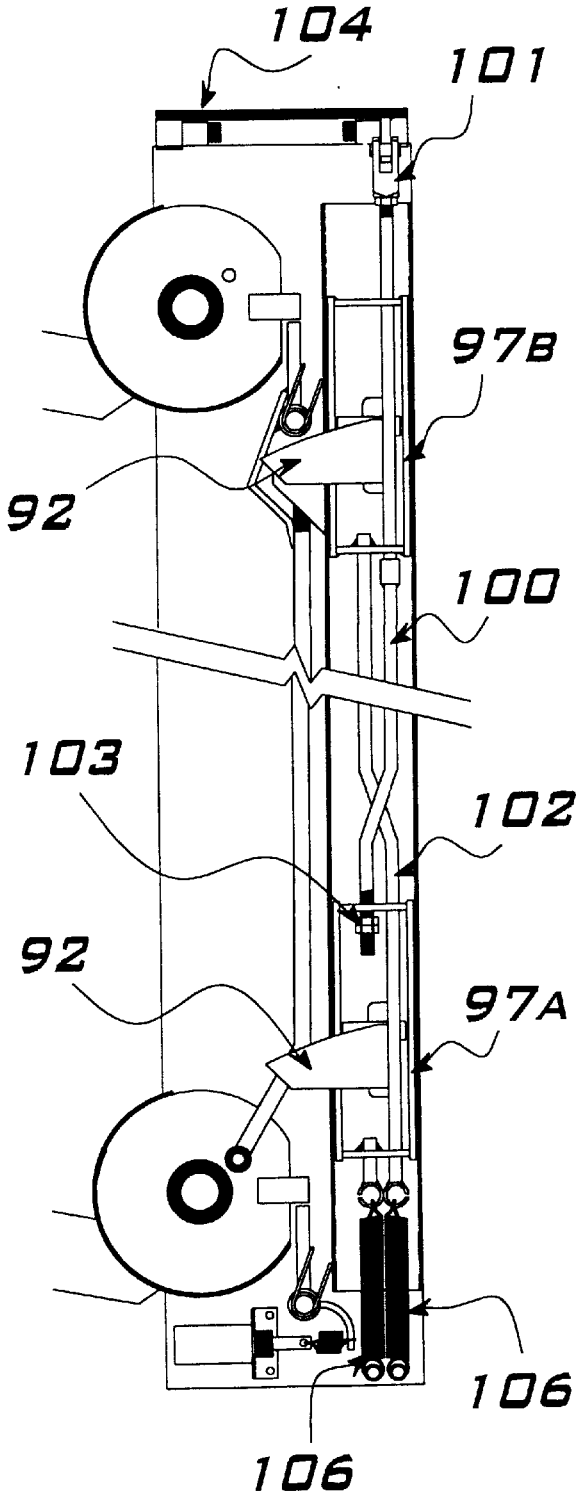
FIGS. 16*a* and 16*b* are partial top plan views illustrating roller frames.

Now referring to FIG. 16*a*, the structure providing said displaceable locking means 88 comprises a roller frame 97*a* and 97*b* corresponding to each of said collapsing ramps 92 presented by said entrance device 10, depending on the means used to support said top member 16, as provided above, As best shown in FIG. 15, said roller frame 97*a* and 97*b* each define an opening 99 for receiving a shaft about which break away roller 98 rotates within said roller frame 97*a* and 97*b*.

Again referring to FIG. 16*a*, each of said roller frames 97*a* and 97*b* are interconnected by means of a pair of rods 100, 102. Top member 16 is also provided with a collapsing means release handle 104 which is connected to the adjacent roller frame 97*a* and 97*b* for engaging said rods 100, 102 to consequently displace said roller frames 97, using for example a hinged handle in combination with a clevis 101 for displacing said rods 100, 102.

Top member 16 also provides two spring mechanisms 106 opposite to said collapsing means release handle 104 corresponding to each of said pair of rods 100, 102. Said spring mechanisms 106 present means for bias said roller frames 97, and consequently said break away rollers 98, toward said breakaway ramp 92.

Referring to FIGS. 15 and 14*a*, said barrier arms obstruct traversal through said passageway as said break away roller 98 engage said locking notch 96, thereby preventing said top member 16 from being pivoted to achieve said collapsed position.

Figure 16B:
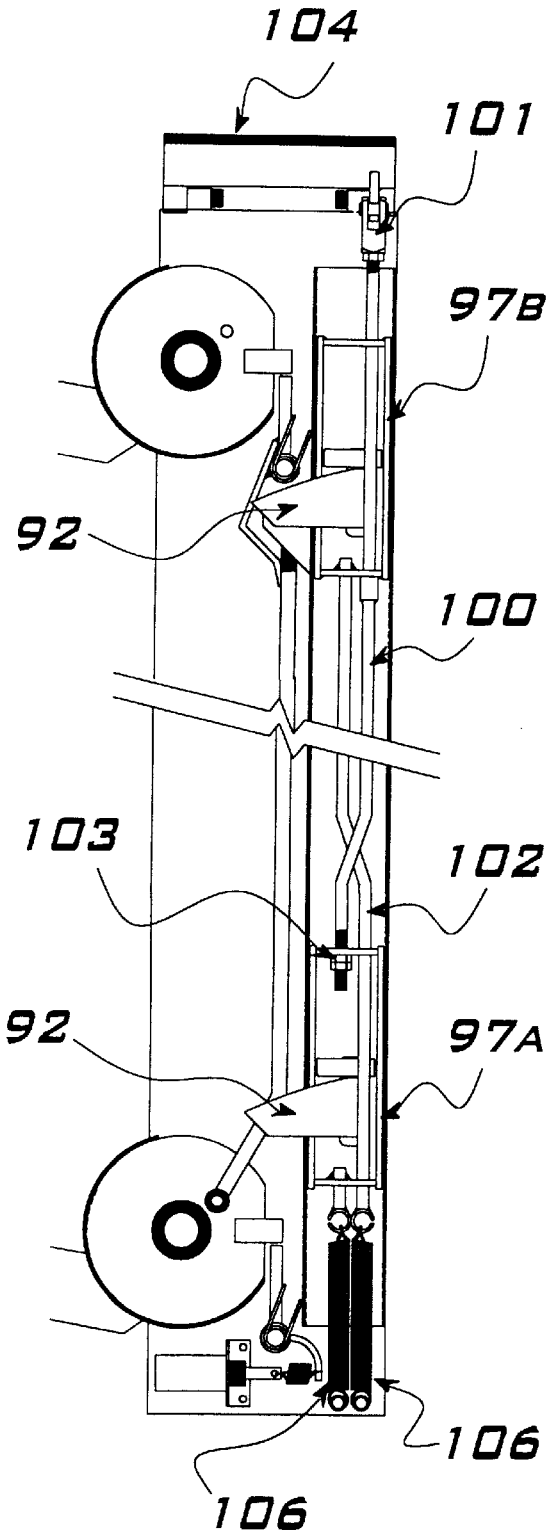

As best shown in FIG. 16*b*, in operation, when said collapsing means release handle 104 is engaged, said rods 100, 102 cause said roller frames 97*a* and 97*b* to be displaced, thereby removing said break away rollers 98 from said locking notches 96, thereby permitting top member 16 from being pivoted about binge means 86 to achieved said collapsed position. The roller frames 97*a* and 97*b* generally move in unison with one another to remove the break away rollers 98 from the locking notches 96. However, the frames 97*a* and 97*b* can move independently of one another since rod 102 is welded to frame 97*b* but traverses through frame 97*a* (frame 97*a* has two holes permitting rod 102 to move freely of frame 97*a*). In other words, by pulling handle 104 then 97*b* is moved by rod 100 while frame 97*a* is moved by rod 100; but a self adjustment means (i.e. locking nuts 103) are provided to allow adjustment so that both frame 97*a* and 97*b* move appropriately in unison.

Figure 17:
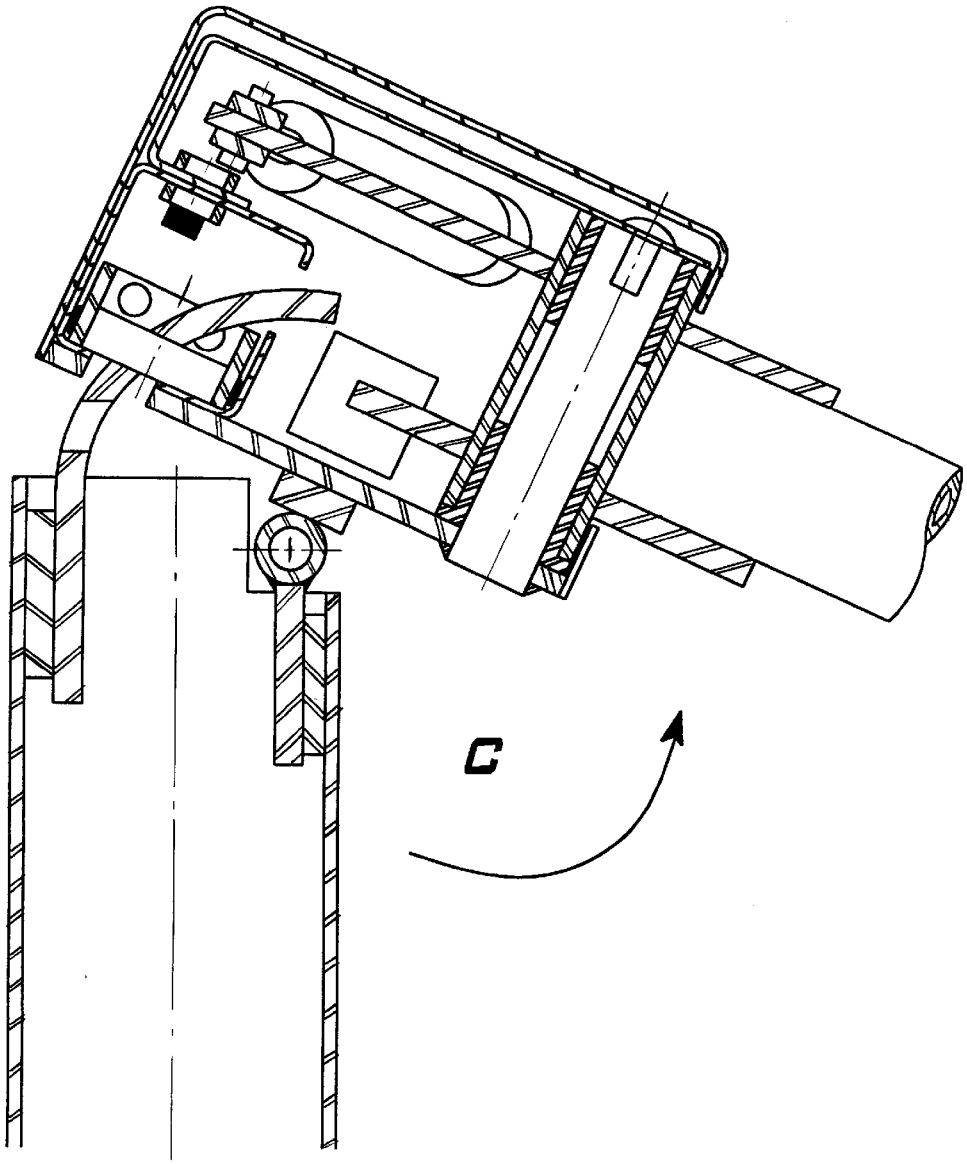
FIG. 17 is a partial cross-sectional view of the access control device illustrating collapsing of the device.

In order to return top member 16 to said first position wherein said barrier arms 20, 22, 24 obstruct traversal through said passageway, said top member 16 is pivoted in direction C, as shown in FIG. 17. As said break away rollers 98 are bid toward said collapsing ramp 92, said break away rollers 98 travel up ramp edge 94 to locate said locking notches 96 when said top member 16 has been pivoted in direction C so as to permit communication between said locking notches 96 and break away rollers 98, thereby locking said top member 16 in place, as described above.

Other means can be provided to permit the barrier arm to swing out of operable position in the event of an emergency. For Example, the barrier arms 20, 22 and 24 may be releasably secured to the upper and lower rotor plates 48 and 42 for rotation as described. In the event of an emergency the handle 104 could be pulled so as to release the arms 20, 22 an 24 for free pivotal movement with respect to the plates 42 and 48. In other words, the arms 20, 22 and 24 could freely horizontally swing in either direction A or B by manually pushing same. In this case, the handle 104 would release a pin so as to disengage the arms 20, 22 and 24 from plates 42 and 48.

An advantage of the present invention over turnstile-type entrance devices is that the entrance device disclosed herein can be negotiated by persons using a wheelchair, in which case said barrier arms are generally displaced by the shoulders of a person of average height, or by a person pushing a shopping cart or stroller. Separate entrances are required in these circumstances where an ordinary turnstile-type entrance is used. Furthermore, the device may also be used in airports where individuals usually hold luggage in their arms. By utilizing the device herein there would be no need to lift the luggage over the device but rather to just walk through with the luggage dangling from the arms.

While the preferred embodiments of the invention described herein refer to use of barrier arms as means of obstructing passage through said passageway, it should also be understood that alternate means for obstructing passage through said entrance devices could be used such as a series of U-shaped gate assemblies, paddles or the like.

Also, the preferred embodiments of the invention described herein, provide for each of said partition member to have two or three barrier arms. However, it is also possible to provide for four, five or more barrier arms if need be.

Also, in order to achieve the benefits of the invention, said barrier arms should be spaced apart along said partition members at a distance that is sufficient to make it difficult for a person seeking entrance through said entrance device in said direction B by displacing the first barrier arm, and then subsequent barrier arms sequentially to gain passage through said last pair of barrier arms.

Figure 18:
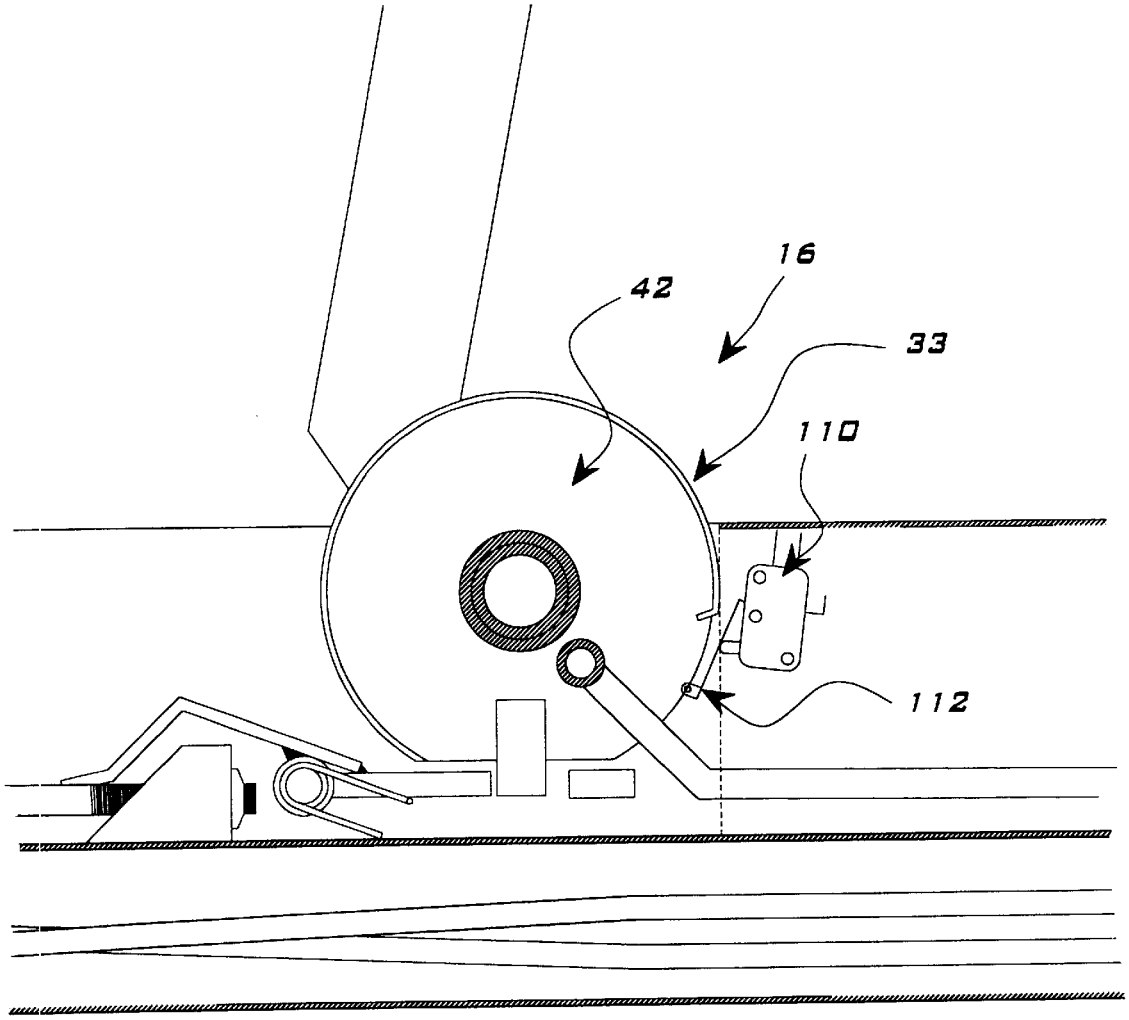
FIG. 18 illustrates the access control device with a detecting means.

Said top member can be further provided with a detecting means operably associated with at least one of said barrier arms for sensing when said barrier arms are displaced from said first closed position to said second open position, and providing signals to a microprocessor for generating data related to the traffic passing through said entrance device, or to a security monitor or camera or other device which monitors traffic activity. As shown in FIG. 18, said detecting means may be provided, for example, by an ordinary solenoid switch 110, having a solenoid connection arm 112. Said solenoid switch 110 is operably associated with said rotor bottom plate 42. Said solenoid switch comprises a spring means (not shown) which biases said solenoid connection arm toward said rotor bottom plate 42. Said solenoid switch is easily adjusted to provide an electronic signal when said rotor bottom plate 42 is rotated, as described above, thereby engaging said solenoid connection arm 112. A counting means can then be operably associated with said detecting means for tracking traffic flowing through said entrance device.

It will be understood from the above description, that if a person attempts to traverse the preferred embodiments of said entrance device presenting said mechanical sequential releasing means and it takes more time than was anticipated for such person to traverse said embodiment of the entrance device when adjusting said biasing means and dampening cylinder, then it is possible that such person may be trapped between two sets of barrier means, if the previous barrier means has returned to said first closed position before the next barrier means is manually displaced. While it would be relatively simple to displace the previous barrier means to release the next barrier means, some persons traversing said entrance device may not realize this fact, or perhaps may not be able to do so due to physical impediment, for example. To address this eventuality, said entrance device may be easily equipped with an alarm means comprising, for example, a timer in combination with a solenoid switch which provide an alarm signal if a person has traversed, for example, said first barrier means, and a certain period of time has elapsed and said second barrier means has not yet been manually displaced. Said alarm signal could result in a siren being sounded, for example, either in the immediate vicinity of said entrance device or at an administrative office, for example.

The working components of said entrance device are readily available and can be assembled in a manner well-known to those skilled in the art. Said main base plate 30, support posts and casing 26 may be fashioned from sheet metal, but may also comprise some other rigid material such as a rigid plastic polymer or wood.

Various embodiments of the invention have now been described in detail. Since changes in and/or additions to the above-described best mode may be made without departing from the nature, spirit or scope of the invention, the invention is not to be limited to said details. Specifically, suggested components assembled in suggested mechanical relationships have been described herein to obtain the benefits of the invention, however, it should be understood that various different components and alternate modes of assembly may be used to achieve the benefits of the same invention without diverging from the invention disclosed herein.

I claim:

1. An access control device to permit passage in one direction comprising:

(a) at least one partition member defining a passageway;

(b) first means for barring passage manually displaceable from a closed position to an open position; and (c) a second means for barring passage manually displaceable from a closed position to an open position;

wherein said first and second means for barring passage are mounted on said partition member, wherein said first and second means for barring passage are operatively connected so that the manual displacement of said second means for barring passage is operable after the manual displacement of said first means for barring passage, and wherein said access control device further comprises a means for releasing said first and second means for barring passage comprising:

(a) a stopping member which prevents said second means for barring passage from being manually displaced from said closed position to achieve said open position; and (b) a releasing member connected to said first and second means for barring passage for releasing said stopping member in response to said first means for barring passage being displaced to achieve said open position so that said second means for barring passage becomes operable for manual displacement.

2. An access control device as claimed in claim 1, wherein said releasing member comprises an electronic releasing means operably associated with said first and second means for barring passage, said electronic releasing means presenting means for releasing said stopping member when said first means for barring passage is manually displaced.

3. An access control device as claimed in claim 2, wherein said electronic releasing means comprises a solenoid.

4. An access control device as claimed in claim 1, wherein said first means for barring passage comprises:

(a) a means for preventing said first means for barring passage from being manually displaced from said closed position to achieve said open position; and (b) circuit means for releasing said means for preventing said first means for barring passage from being manually displaced from said closed position to achieve said open position thereby allowing said first means for barring passage to be manually displaced.

5. An access control device as claimed in claim 4, wherein said circuit means comprises a solenoid.

6. An access control device as claimed in claim 1, wherein said first means for barring passage is presented by a first barrier arm and said second means for barring passage is presented by a second barrier arm.

7. An access control device as claimed in claim 6, wherein said access control device further comprises a biasing means connected with each of said first and second barrier arms for biasing said first and second barrier arms to said closed position.

8. An access control device as claimed in claim 7, wherein said access control device provides a means for inhibiting movement of said first and second barrier arms in a direction other than said one direction.

9. An access control device to permit passage in one direction comprising:

(a) at least one partition member defining a passageway;

(b) a first barrier arm assembly mounted on one of said at least one partition member, said first barrier arm assembly comprising:

(i) a first barrier arm; and (ii) a first barrier arm rotor connected to said first barrier arm and rotatably mounted on said one of said at least one partition member; and adapted for manual rotation of said first barrier arm between an open position and a closed position; and (c) a second barrier arm assembly mounted on said one of said at least one partition member and spaced apart from said first barrier arm assembly, said second barrier assembly comprising:

(i) a second barrier arm;

(ii) a second barrier arm rotor connected to said second barrier arm and rotatably mounted on said one of said at least one partition member; and adapted for manual rotation of said second barrier arm between an open position and a closed position; and (iii) a means for releasing barrier arm rotors sequentially comprising:

(A) a means for stopping said barrier arms comprising:

a stopping member presented by said one of said at least one partition member adjacent to said second barrier arm rotor; and a stopping arm presented by said second barrier arm rotor and operably associated with said stopping member wherein said means for stopping said barrier arms prevents rotation of said second barrier arm rotor from said closed position toward said open position; and (B) a releasing member for displacing said stopping member, thereby releasing said means for stopping said barrier arms when said first barrier arm rotor is rotated from said closed position toward said open position, and thereby allowing rotation of said second barrier arm rotor from said closed position toward said open position.

10. An access control device as claimed in claim 9, wherein said first and second barrier arms are biased to said closed position.

11. An access control device as claimed in claim 10, wherein said access control device comprises a means for inhibiting movement of said first and second barrier arms in a direction other than said one direction.

12. An access control device as claimed in claim 9, wherein said access control device further comprises a collapsing means for manually displacing said first and second barrier arms from said closed position or open position to achieve a collapsed position wherein said first and second barrier arms permit unobstructed passage through said passageway.

13. An access control device as claimed in claim 12, wherein said partition member comprises:

(a) a top member for receiving said first and second barrier arm assemblies; and (b) a means for supporting said top member.

14. An access control device as claimed in claim 13, wherein collapsing means collapses said barrier arms by pivoting said top member;

(a) from a first position in which said first and second barrier arms obstruct passage through said passageway; and (b) to a second position in which said first and second barrier arms are substantially parallel with said means for supporting said top member thereby permitting unobstructed passage through said passageway in either direction.

15. An access control device as claimed in claim 14, wherein said collapsing means comprises:

(a) a pivot member presented by said means for supporting said top member for displacement of said top member about said pivot;

(b) a pivot lock for restricting displacement of said top member about said pivot; and (c) a pivot release member for releasing said pivot lock to permit displacement of said top member about said pivot.

16. An access control device as claimed in claim 15, wherein said pivot lock is presented by:

(a) a ramp member presented by said means for supporting said top member;

(b) a ramp edge presented by said ramp member;

(c) a locking notch presented by said ramp edge; and (c) a locking bar presented by said top member which is connected to said ramp edge and adapted to locate and engage said locking notch thereby preventing displacement of said top member about said pivot, wherein said locking bar is biased to engage said locking notch.

17. An access control device as claimed in claims 15 or 16, wherein said pivot release member comprises a means for displacing said locking bar from said locking notch thereby permitting pivotably displacement of said top member.

18. An access control device to permit passage in one direction comprising:

(a) a pair of partition members defining a passageway;

(b) a first barrier assembly mounted on one of said partition members, said first barrier assembly comprising:

(i) a first barrier arm; and (ii) a first barrier arm rotor connected to said first barrier arm and rotatably mounted on said one of said partition members; and adapted for manual rotation of said first barrier arm between an open position and a closed position;

(c) a second barrier arm assembly mounted on said one of said partition members and spaced apart from said first barrier arm assembly, said second barrier assembly comprising:

(i) a second barrier arm;

(ii) a second barrier arm rotor connected to said second barrier arm and rotatably mounted on said one of said partition members; and adapted for manual rotation of said second barrier arm between an open position and a closed position; and (iii) a first means for releasing barrier arm rotors sequentially comprising:

(A) a first means for stopping said barrier arms comprising:

a first stopping member presented by said partition member adjacent to said second barrier arm rotor; and a first stopping arm presented by said second barrier arm rotor and operably associated with said first stopping member wherein said first means for stopping said barrier arms prevents rotation of said second barrier arm rotor from said closed position toward said open position; and (B) a first releasing means for displacing said first stopping member, thereby releasing said first means for stopping said barrier arms when said first barrier arm rotor is rotated from said closed position toward said open position, and thereby allowing rotation of said second barrier arm rotor from said closed position toward said open position; and (d) a third barrier arm assembly mounted on said one of said partition members and spaced apart from said second barrier arm assembly, said third barrier assembly comprising:

(i) a third barrier arm;

(ii) a third barrier arm rotor connected to said third barrier arm and rotatably mounted on said one of said partition members; and adapted for manual rotation of said third barrier arm between an open position and a closed position; and (iii) a second means for releasing barrier arm rotor comprising:

(A) a second means for stopping said barrier-arms comprising:

a second stopping member presented by said partition member adjacent to said third barrier arm rotor; and a second stopping arm presented by said third barrier arm rotor and operably associated with said second stopping member wherein said second means for stopping prevents rotation of said third barrier arm rotor from said closed position toward said open position; and (B) a second releasing means for displacing said second stopping member, thereby releasing said second means for stopping said barrier arms when said second barrier arm rotor is rotated from said closed position toward said open position, and thereby allowing rotation of said third barrier arm rotor from said closed position toward said open position.

19. An access control device as claimed in claim 18, wherein said first, second and third barrier arms are biased to said closed position.

20. An access control device as claimed in claim 19, wherein said access control device comprises means for inhibiting movement of said first, second and third barrier arms in a direction other than said one direction.

21. An access control device as claimed in claim 18, wherein movement of said first, second and third barrier arms in a direction other than said one direction is inhibited by a blocking means associated with said one of said partition members adjacent to said first, second and third barrier arm rotor respectively.

22. An access control device as claimed in claim 21, wherein said access control device further comprises a collapsing means for manually displacing said first, second and third barrier arms from said closed position or open position to achieve a collapsed position wherein said first, second and third barrier arms permit unobstructed passage through said passageway.

23. An access control device as claimed in claim 22, wherein at least said one of said partition members comprises:

(a) a top member for receiving said first, second and third barrier arm assemblies; and (b) a means for supporting said top member.

24. An access control device as claimed in claim 23, wherein said collapsing means collapses said barrier arms by pivoting said top member:

(a) from a first position in which said first, second and third barrier arms obstruct passage through said passageway; and (b) to a second position in which said first, second and third barrier arms are substantially parallel with said means for supporting said top member thereby permitting unobstructed passage through said passageway in either direction.

25. An access control device as claimed in claim 24, wherein said collapsing means comprises:

(a) a pivot member presented by said means for supporting said top member for displacement of said top member about said pivot;

(b) a pivot lock for restricting displacement of said top member about said pivot; and (c) a pivot release member for releasing said pivot lock to permit displacement of said top member about said pivot.

26. An access control device as claimed in claim 25, wherein said pivot lock is presented by:

(a) a ramp member presented by said means for supporting said top member;

(b) a ramp edge presented by said ramp member;

(c) a locking notch presented by said ramp edge; and (c) a locking bar presented by said top member which is connected to said ramp edge and adapted to locate and engage said locking notch thereby preventing displacement of said top member about said pivot member, wherein said locking bar is biased to engage said locking notch.

27. An access control device as claimed in claims 25 or 26 wherein said pivot release member comprises means for displacing said locking bar from said locking notch thereby permitting pivotably displacement of said top member.

28. An access control device comprising to permit passage in one direction comprising:

(a) a pair of partition members spaced apart so as to define a passageway therebetween; and (b) a barrier means presented by each of said partition members comprising;

(i) a first barrier arm assembly mounted on one of said pair of partition members, said first barrier arm assembly comprising:

(A) a first barrier arm; and (B) a first barrier arm rotor connected to said first barrier arm and rotatably mounted on said partition member; and adapted for manual rotation of said first barrier arm between an open position and a closed position; and (ii) a second barrier arm assembly mounted on said partition member and spaced apart from said first barrier arm assembly, said second barrier assembly comprising:

(A) a second barrier arm;

(B) a second barrier arm rotor connected to said second barrier arm and rotatably mounted on said partition member; and adapted for manual rotation of said second barrier arm between an open position and a closed position;

(C) a means for releasing barrier arm rotors sequentially comprising:

(1) a means for stopping said barrier arms comprising:

a stopping member presented by said partition member adjacent to said second barrier arm rotor; and a stopping arm presented by said second barrier arm rotor and operably associated with said stopping member wherein said means for stopping said barrier arms prevents rotation of said second barrier arm rotor from said closed position toward said open position; and (2) a releasing means for displacing said stopping member, thereby releasing said means for stopping said barrier arms when said first barrier arm rotor is rotated from said closed position toward said open position, and thereby allowing rotation of said second barrier arm rotor from said closed position toward said open position wherein the end of each of said first and second barrier arms of one of said partition members distal to said first and second barrier arm rotors thereof is substantially opposite to the end of each of said first and second barriers arms of the other of said partition members distal to said first and second barrier arm rotors thereof.

29. An access control device as claimed in claim 28, wherein said first and second barrier arms are biased to said closed position.

30. An access control device as claimed in claim 29, wherein said access control device comprises means for inhibiting movement of said first and second and barrier arms in a direction other than said one direction.

31. An access control device as claimed in claim 30, wherein movement of said first and second barrier arms in a direction other than said one direction is inhibited by a blocking means associated with said top member adjacent to said first and second barrier arm rotor respectively.

32. An access control device as claimed in claim 28, wherein said access control device further comprises a collapsing means for manually displacing said first and second barrier arms from said closed position or open position to achieve a third collapsed position wherein said first and second barrier arms permit unobstructed passage through said passageway.

33. An access control device as claimed in claim 32, wherein said partition member comprises:

(a) a top member for receiving said first, and second barrier arm assemblies; and (b) means for supporting said top member.

34. An access control device as claimed in claim 33, wherein movement of said first and second barrier arms in a direction other than said one direction is presented by a blocking means associated with said top member adjacent to each of said first and second barrier arm rotor respectively.

35. An access control device as claimed in claim 34, wherein said means for supporting said top member presents a collapsing means for pivoting said top member:

(a) from a first position in which said first and second barrier arms obstruct passage though said passageway; and (b) to a second position in which said first and second barrier arms are substantially parallel with said supporting post thereby permitting unobstructed passage through said passageway in either direction.

36. An access control device as claimed in claim 33, wherein said collapsing means comprises:

(a) a pivot member presented by said means for supporting said top member for displacement of said top member about said pivot;

(b) a pivot lock for restricting displacement of said top member about said pivot; and (c) a pivot release member for releasing said pivot lock to permit displacement of said top member about said pivot.

37. An access control device as claimed in claim 36, wherein said hinge locking means is presented by:

(a) a ramp member presented by said means for supporting said top member;

(b) a ramp edge presented by said ramp member, (c) a locking notch presented by said ramp edge; and (d) a locking bar presented by said top member which is connected to said ramp edge and adapted to locate and engage said locking notch thereby preventing displacement of said top member about said pivot member, wherein said locking bar is biased to engage said locking notch.

38. An access control device as claimed in claims 36 or 37 wherein said pivot release member comprises means for displacing said locking bar from said locking notch thereby permitting pivotably displacement of said top member.

39. An access control device comprising to permit passage in one direction comprising:

(a) a pair of partition members spaced apart so as to define a passageway therebetween; and (b) a barrier means presented by each of said partition members comprising:

(i) a first barrier arm assembly mounted on one of said pair of partition members, said first barrier arm assembly comprising:

(A) a first barrier arm; and (B) a first barrier arm rotor connected to said first barrier arm and rotatably mounted on said partition member; and adapted for manual rotation of said first barrier arm between an open position and a closed position;

(ii) a second barrier arm assembly mounted on said partition member and spaced apart from said first barrier arm assembly, said second barrier assembly comprising:

(A) a second barrier arm;

(B) a second barrier arm rotor connected to said second barrier arm and rotatably mounted on said partition member; and adapted for manual rotation of said second barrier arm between an open position and a closed position; and (C) a first means for releasing barrier arm rotors sequentially comprising (1) a first means for stopping said barrier arms comprising:

a first stopping member presented by said partition member adjacent to said second barrier arm rotor; and a first stopping arm presented by said second barrier arm rotor and operably associated with said first stopping member wherein said first means for stopping said barrier arms prevents rotation of said second barrier arm rotor from said closed position toward said open position; and (2) a first releasing means for displacing said first stopping member, thereby releasing said first means for stopping said barrier arms when said first barrier arm rotor is rotated from said closed position toward said open position, and thereby allowing rotation of said second barrier arm rotor from said closed position toward said open position; and (iii) a third barrier arm assembly mounted on said partition member and spaced apart from said second barrier arm assembly, said third barrier assembly comprising:

(A) a third barrier arm;

(B) a third barrier arm rotor connected to said third barrier arm and rotatably mounted on said partition member; and adapted for manual rotation of said third barrier arm between an open position and a closed position; and (C) a second means for releasing barrier arm rotors sequentially comprising:

(1) a second means for stopping said barrier arms comprising:

a second stopping member presented by said partition member adjacent to said third barrier arm rotor; and a second stopping arm presented by said third barrier arm rotor wherein said second means for stopping said barrier arms prevents rotation of said third barrier arm rotor from said dosed position toward said open position; and (2) a second releasing means for displacing said second stopping member, thereby releasing said second means for stopping said barrier arms when said second barrier arm rotor is rotated from said closed position toward said open position, and thereby allowing rotation of said third barrier arm rotor from said closed position toward said open position wherein the end of each of said first, second and third barrier arms of one of said partition members distal to said first, second and third barrier arm rotors thereof is substantially opposite to said first, second and third barriers arms of the other of said partition members distal to said first, second and third barrier arm rotors thereof.

40. A method of traversing an access control device having at least a first and second manually operable barrier arms mounted on at least one of a pair of partition members wherein said first and second manually operable barrier arms are operatively connected so that manual displacement of said second barrier arm is operable after manual displacement of said first barrier arm comprising the steps of:

(a) manually displacing said first barrier arm so as to allow passage past said first barrier arm;

(b) manual displacement of said first barrier arm rendering manual displacement of said second barrier arm operable so as to allow passage past said second barrier arm; and (c) manually displacing said second barrier arm so as to traverse said access control device.

41. A method of traversing an access control device as claimed in claim 40, further comprising the step of said first and second barriers arms returning to said closed position after traversing said access control device.

42. A method of traversing an access control device having at least a first and second manually operable gate assemblies mounted in spaced apart relationship on a pair of partition members wherein said gate assemblies each comprise a pair of corresponding barrier arms, wherein said gate assemblies are operatively connected so that manual displacement of said barrier arms of said second gate assembly is operable after the manual displacement of said barrier arms of said first gate assembly, and wherein said access control device further comprises a means for releasing said first and second means for barring passage comprising:

(a) a stopping member which prevents said second means for barring passage from being manually displaced from said closed position to achieve said open position; and (b) a releasing member connected to said first and second means for barring passage for releasing said stopping member in response to said first means for barring passage being displaced to achieve said open position comprising the steps of:

(a) manually displacing said first pair of barrier arms so as to allow passage past said first pair of barrier arms;

(b) manual displacement of said first pair of barrier arms rendering manual displacement of said second pair of barrier arms operable so as to allow passage past said second pair of barrier arms; and (c) manually displacing said second pair of barrier arms so as to traverse said access control.

43. A method of traversing an access control device as claimed in claim 42, further comprising the step of said first and second pairs of barriers arms returning to said closed position after traversing said access control device.

44. An access control device to permit entrance in one direction comprising:

(a) at least one partition member defining a passageway;

(b) first barrier assembly mounted on one of said partition member, said first barrier assembly comprising:

(i) a first barrier; and (ii) first barrier pivot connected to said first barrier for pivoting said first barrier from an open position to a closed position; and (c) second barrier assembly mounted on said partition member and spaced apart from said first barrier arm assembly, said second barrier assembly comprising:

(i) a second barrier;

(ii) second barrier pivot connected to said second barrier for pivoting said first barrier from an open position to a closed position;

(iii) means for releasing barriers sequentially comprising:

(A) means for stopping said barriers comprising:

a stopping member presented by said partition member adjacent to said second barrier pivot; and stopping arm presented by said second barrier pivot and operably associated with said stopping member wherein said means for stopping said barrier arms prevents pivoting of said second barrier from said closed position toward said open position; and (B) releasing member for displacing said stopping member, thereby releasing said means for stopping said barriers when said first barrier pivot is pivoted from said closed position toward said open position, and thereby allowing pivoting of said second barrier pivot from said closed position toward said open position.

45. An access control device to permit passage in one direction comprising:

(a) at least one partition member defining a passageway;

(b) a first means for barring passage manually displaceable from a closed position to an open position; and (c) a second means for barring passage manually displaceable from a closed position to an open position;

wherein said first and second means for barring passage are mounted on said partition member in spaced apart relationship, and wherein said first and second means for barring passage are operatively connected so that the manual displacement of said second means for barring passage is operable after the manual displacement of said first means for barring passage, and wherein said access control device further comprises a means for releasing said first and second means for barring passage comprising:

(a) a stopping member which prevents said second means for barring passage from being manually displaced from said closed position to achieve said open position; and (b) a releasing member connected to said first and second means for barring passage for releasing said stopping member in response to said first means for barring passage being displaced to achieve said open position so that said second means for barring passage becomes operable for manual displacement.

* * * * *